United States Patent [19]

Hamakawa et al.

[11] Patent Number: 5,060,925

[45] Date of Patent: Oct. 29, 1991

[54] DOCUMENT FEEDING APPARATUS

[75] Inventors: Wataru Hamakawa; Hirokazu Matsuo; Yuusuke Morigami, all of Osaka, Japan

[73] Assignee: Minolta Camera Kabushiki Kaisha, Osaka, Japan

[21] Appl. No.: 467,369

[22] Filed: Jan. 19, 1990

[30] Foreign Application Priority Data

Jan. 20, 1989 [JP] Japan ..... 1-12483
Jan. 20, 1989 [JP] Japan ..... 1-12484

[51] Int. Cl.[5] ..... B65H 7/08

[52] U.S. Cl. ..... 274/111; 271/259; 271/265; 271/242

[58] Field of Search ..... 271/110, 111, 258, 259, 271/265, 242

[56] References Cited

U.S. PATENT DOCUMENTS

| | | | |
|---|---|---|---|
| 3,936,041 | 2/1976 | Shiina et al. | 271/258 |
| 4,052,054 | 10/1977 | Cardwell et al. . | |
| 4,331,328 | 5/1982 | Fasig | 271/259 |
| 4,727,401 | 2/1988 | Partilla et al. . | |
| 4,731,637 | 3/1988 | Acquaviva et al. . | |
| 4,763,160 | 8/1988 | Honjo | 271/259 |
| 4,771,319 | 9/1988 | Hamakawa . | |
| 4,878,657 | 11/1989 | Ura et al. | 271/242 |

FOREIGN PATENT DOCUMENTS

| | | | |
|---|---|---|---|
| 47902 | 2/1979 | Japan | 271/110 |
| 48304 | 4/1983 | Japan | 271/110 |
| 48306 | 6/1983 | Japan | 271/110 |
| 60-2942 | 1/1985 | Japan . | |
| 62-47264 | 2/1987 | Japan . | |
| 48212 | 12/1982 | United Kingdom | 271/265 |

*Primary Examiner*—H. Grant Skaggs
*Assistant Examiner*—C. Druzbick
*Attorney, Agent, or Firm*—Burns, Doane, Swecker & Mathis

[57] ABSTRACT

In a document feeding apparatus, a first motor which drives a transporting mechanism provided at downstream side in the document transporting direction of a pair of timing rollers and a clutch connected with the pair of rollers are firstly energized, and the energized first motor drives the transport mechanism and the pair of timing rollers in the document transporting direction. A second motor which drives a paper feeding mechanism and is provided at upstream side in the document transporting direction of the pair of timing rollers drives the paper feeding mechanism after it is energized for a predetermined period of time to transport two sheets of originals placed and in contact with the pair of timing rollers from its downstream and upstream sides onto a platen glass. A sensor which detects the rear edge of an original being discharged from the platen glass is prohibited from detecting the rear edge of an original firstly discharged.

8 Claims, 33 Drawing Sheets

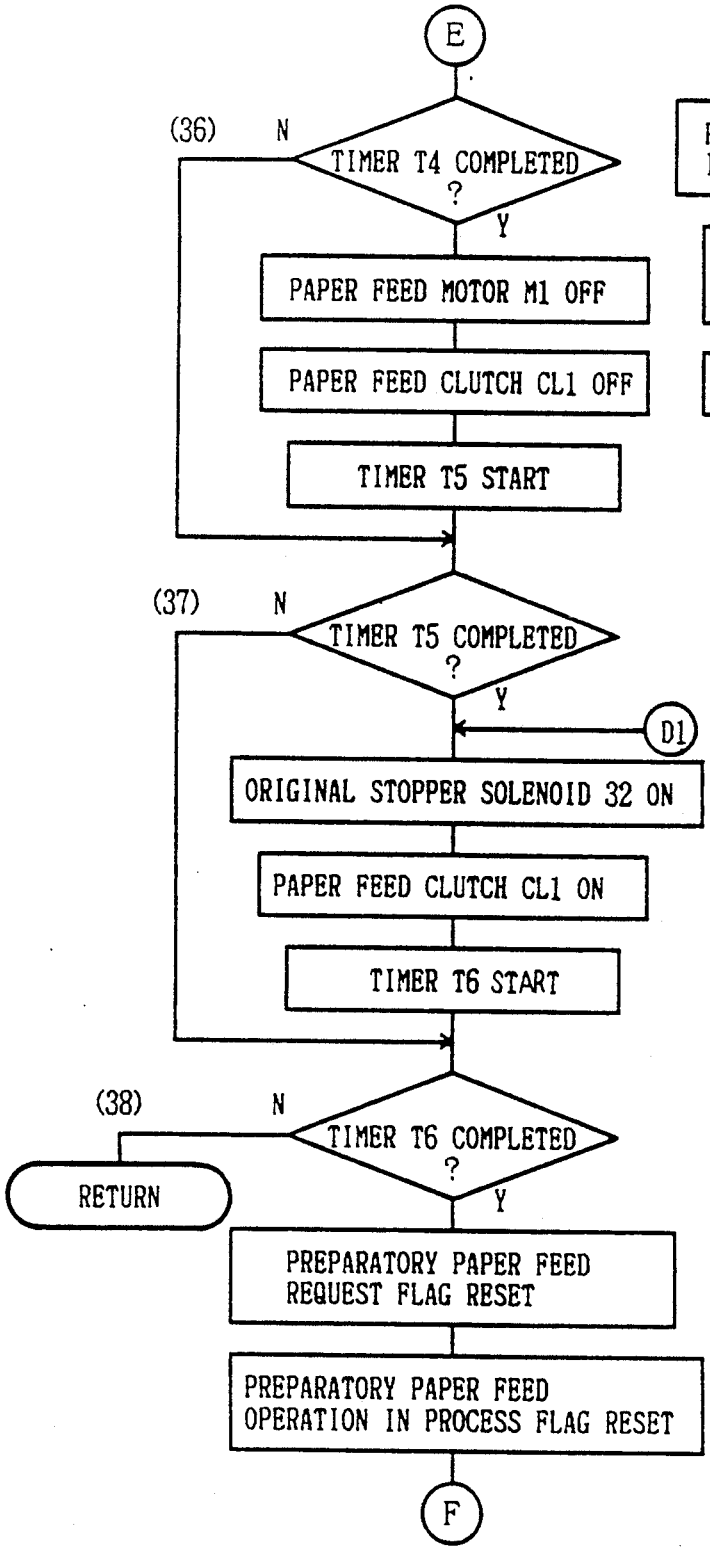
Fig.17
E
(36)
N
TIMER T4 COMPLETED ?
Y
PAPER FEED MOTOR M1 OFF
PAPER FEED CLUTCH CL1 OFF
TIMER T5 START
(37)
N
TIMER T5 COMPLETED ?
Y
D1
ORIGINAL STOPPER SOLENOID 32 ON
PAPER FEED CLUTCH CL1 ON
TIMER T6 START
(38)
N
TIMER T6 COMPLETED ?
RETURN
Y
PREPARATORY PAPER FEED REQUEST FLAG RESET
PREPARATORY PAPER FEED OPERATION IN PROCESS FLAG RESET
F

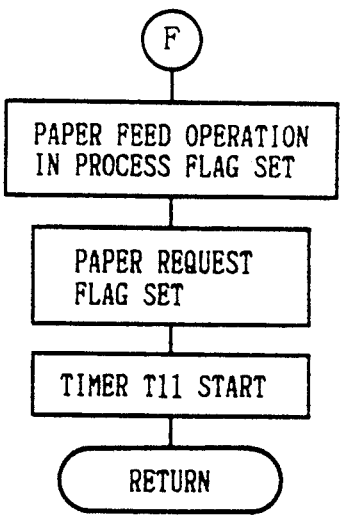
Fig.18
F
PAPER FEED OPERATION IN PROCESS FLAG SET
PAPER REQUEST FLAG SET
TIMER T11 START
RETURN

DOCUMENT FEEDING APPARATUS

BACKGROUND OF THE INVENTION

1. Technical Field of the Invention

The present invention relates to a document feeding apparatus for use in a copying machine, image reader, microphotographing apparatus or the like wherein documents stacked in a document stack tray are automatically fed one by one to a platen where an image is exposed and read or photographed and then discharged automatically, and more particularly, to a document feeding apparatus in which two sheets of originals are once aligned both in front and in the rear of a pair of rollers provided in an intermediate portion of document transport path and then the sheets are automatically transported under subsequent handling mode (hereinafter referred to as two-in-one handling mode) as if they are one sheet of original and are discharged automatically.

2. Description of Related Art

The two-in-one handling mode as described above is simply accomplished by a transport mechanism which includes a downstream side transport means a on the intermediate portion of the transport path, a pair of rollers d, an upstream side transport means e, a first driving source b and a second driving source f. The downstream side transport means a is connected directly to the first driving source b, while the pair of rollers are connected to the first driving source b through a clutch c. The upstream side transport means e is connected directly to the second driving source f. An operation in a conventional method has been processed in a manner which will be described below.

Firstly, the first and second driving sources b, f and the clutch c are turned on to transport a first original OD1. When the trailing end of the first original OD1 has passed through the pair of rollers d, the clutch c and the second driving source f are turned off while the first driving source b is turned on to transport the first original OD1 reversely to the pair of rollers d to adjust the rear edge of the first original OD1 at the nip portion of the rollers. Then, the first driving source b is turned off to stop the downstream side transport means and on the other hand, the second driving source f is turned on to transport a next original OD2 to the pair of rollers d so that the leading edge of the next original OD2 is adjusted at the nip section of the pair of rollers d.

In such a manner, the first original OD 1 and the next original OD2 can be sequentially aligned in front and in the rear of the pair of rollers d as illustrated in this figure. Under the state, each of the first and second driving sources b, f are simultaneously turned on while the clutch c is also turned on to drive the upstream side transport means e, the pair of rollers d and the downstream side transport means a so that the first original OD1 and the next original OD2 are transported in alignment, for instance, onto a platen glass g for copying operation.

On the other hand, the originals OD1 and OD2 sent for copying operation on the platen glass g are discharged by a downstream side transport means h onto an original discharge tray k as shown in FIG. 2. In the discharging operation, a controller confirms the completion of original discharging action by detecting the rear edge of an original being discharged onto the discharge tray k by an original detecting sensor.

In the two-in-one handling mode, originals are often discharged on the original discharge tray with unregistered manner because the rear edge of the original OD1 discharged firstly is pushed out by the leading edge of the original OD2 being subsequently discharged. In order to improve the registration, it is necessary to raise the transport speed of a discharge means a little higher than that of the downstream side transport means a to keep apart the distance between the first original OD1 and the next original OD2. But, in case the distance between the first original OD1 and the next original OD2 exists, the sensor f detects not only the rear edge of the original OD2 but also the rear edge of the original OD1. Therefore, the controller can not confirm the completion of original discharge action exactly by the original detecting sensor.

SUMMARY OF THE INVENTION

A primary object of the present invention is to provide a document feeding apparatus which is capable of accomplishing the two-in-one handling mode successfully.

Another object of the present invention is to provide a document feeding apparatus which is capable of feeding documents without causing troubles of widening an interval between a first original and the next original or overlapping each other.

A further object of the present invention is to provide a document feeding apparatus which is capable of properly performing operational control of the two-in-one handling mode wherein two of the first and the next originals are accurately detected as if they are one sheet of original when originals are discharged under the two-in-one handling mode.

These and other objects and features of the present invention will become more apparent from the following description taken in conjunction with the accompanying drawings which illustrate specific embodiments of the invention.

FIG. **5*a*** is an explanatory view showing how a separation plate of the feeding section is handled.

Figure 6:
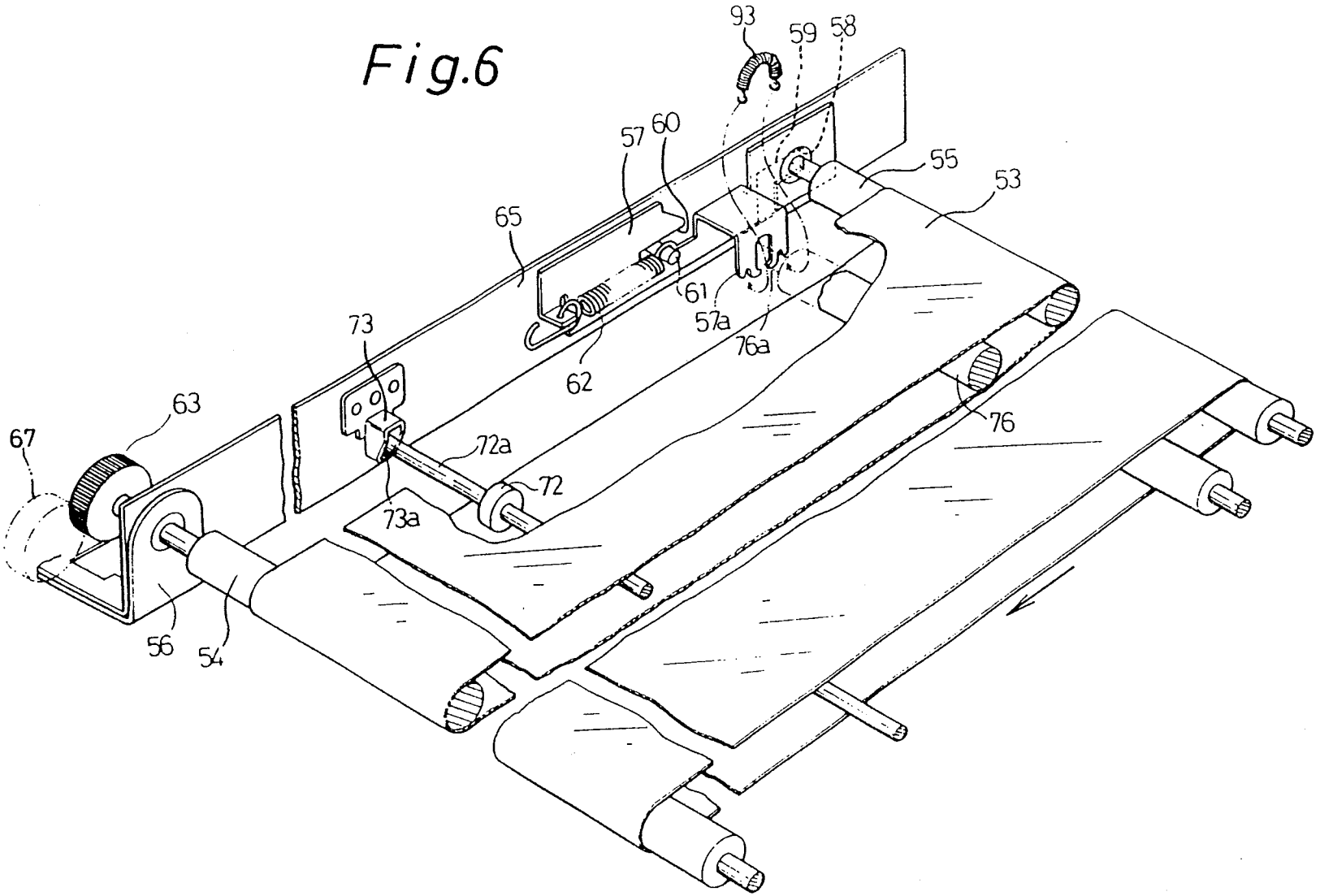

FIG. 6 is a perspective view showing a structure around a transport belt.

Figure 7:
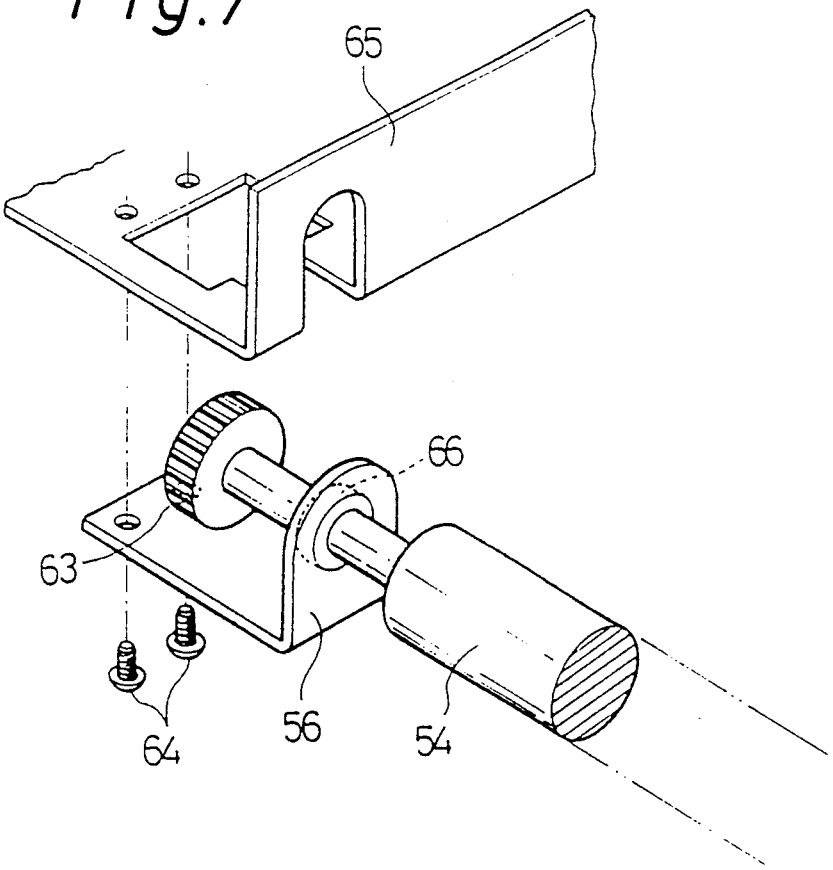

FIG. 7 is an exploded perspective view of the rear end of a driving roller in the transport belt.

Figure 8:
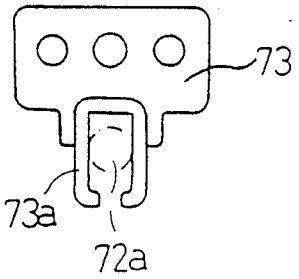

FIG. 8 is a front view of a holder which supports a backup roller.

Figure 9:
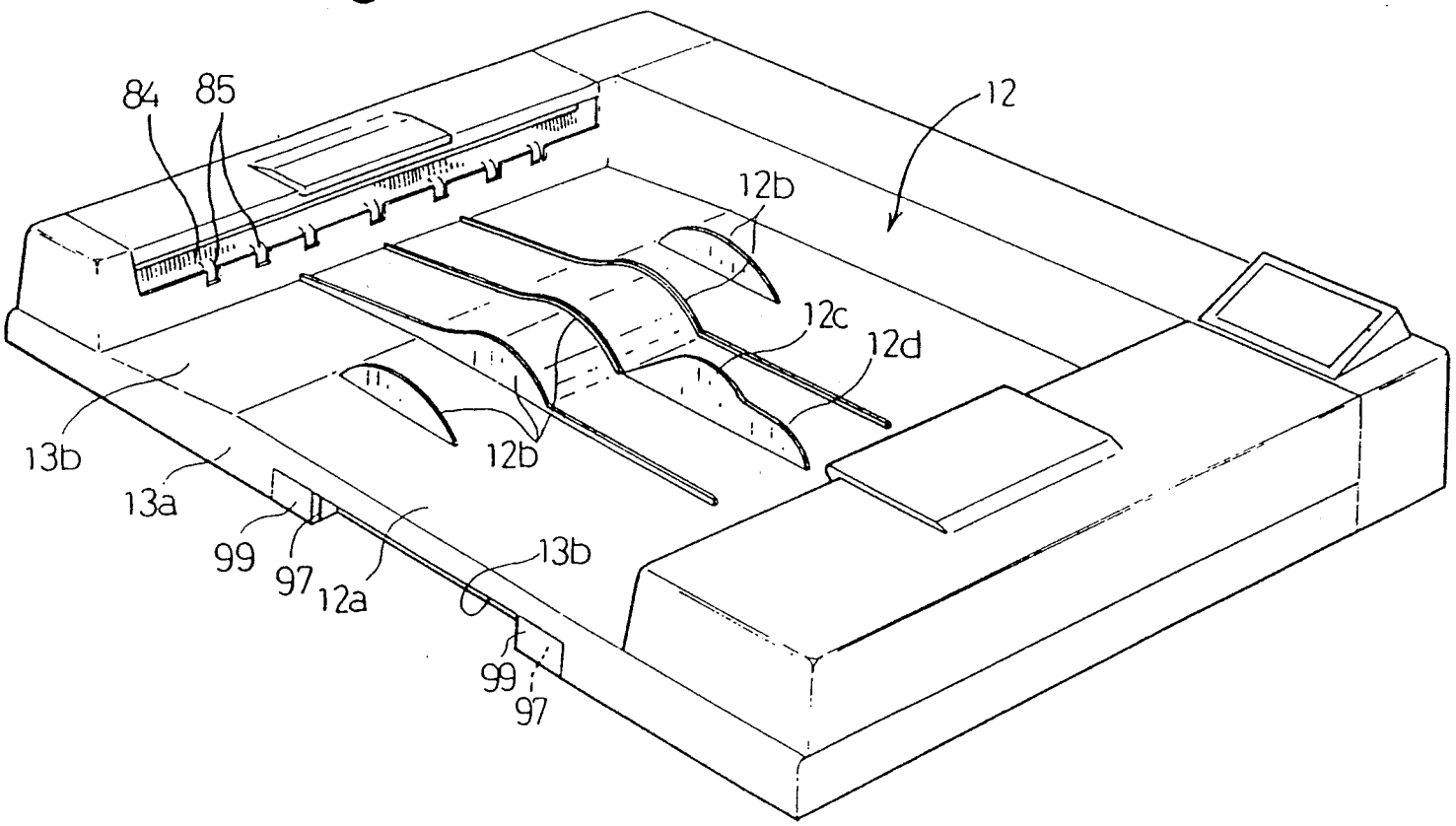

FIG. 9 is a perspective view showing a state when a document stack tray in the document feeding apparatus is removed.

Figure 10:
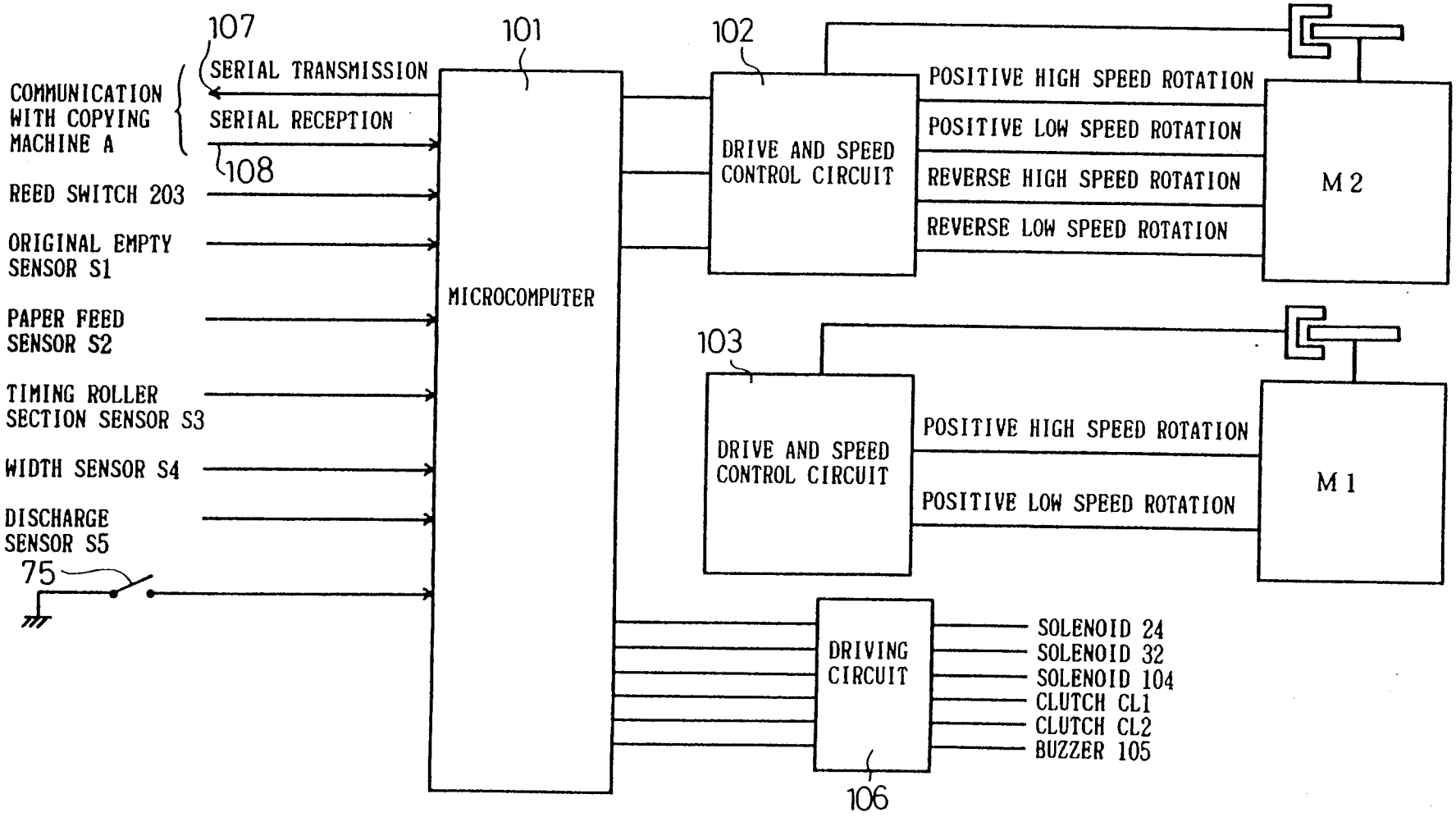

FIG. 10 is a block diagram of a control circuit.

Figure 11:
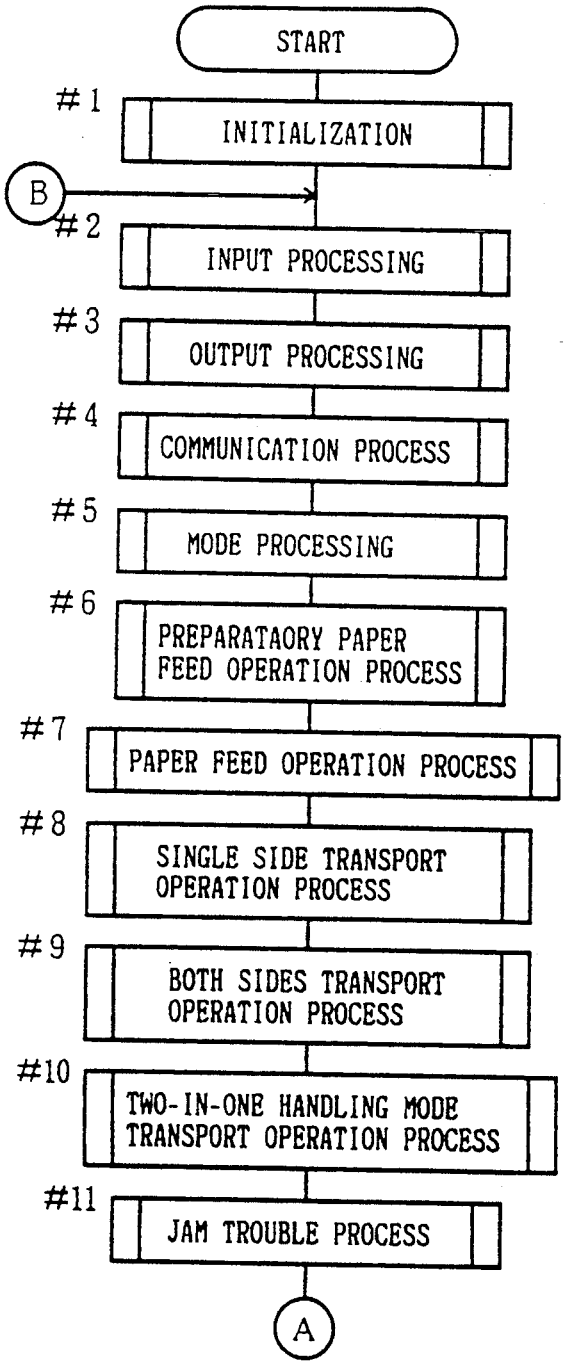
Figure 12:
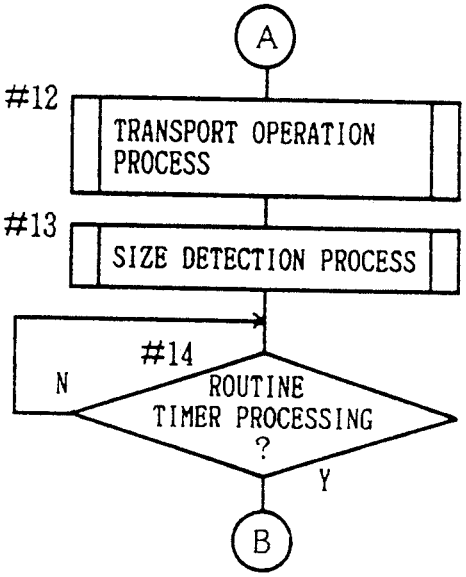

FIGS. 11 and 12 are flow charts showing main routines of operational control.

Figure 13:
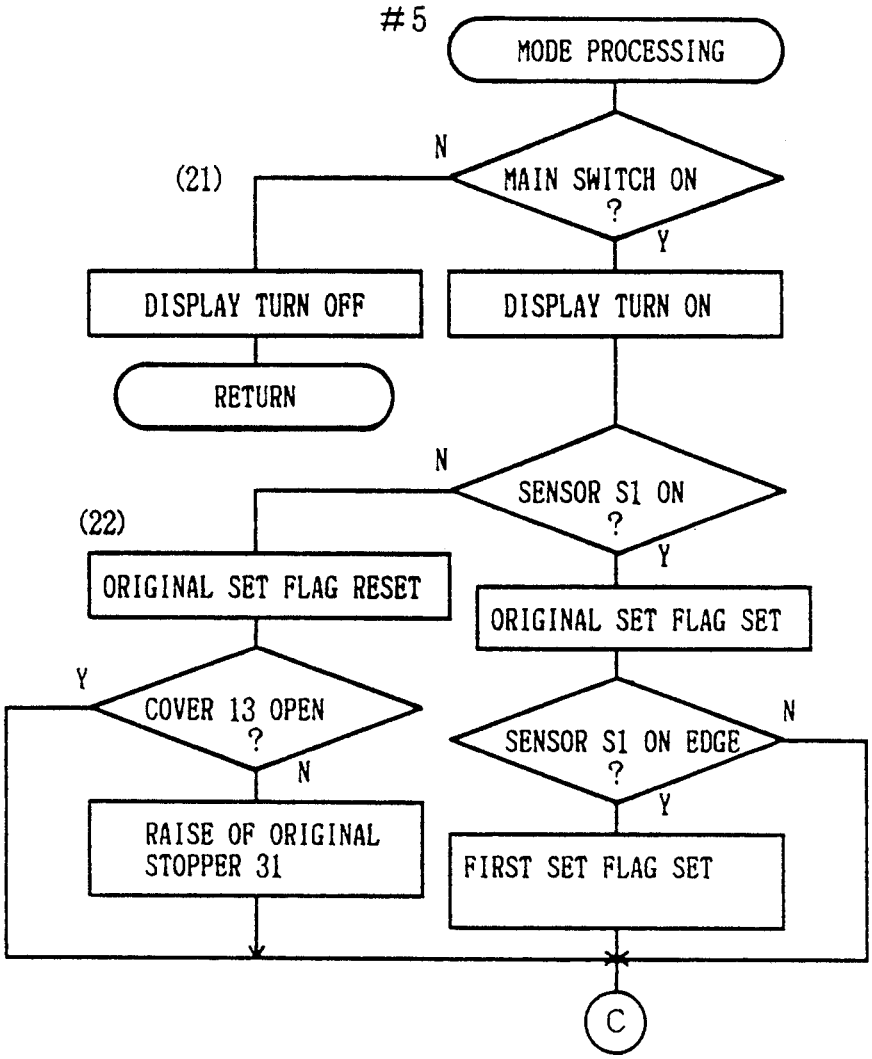
Figure 14:
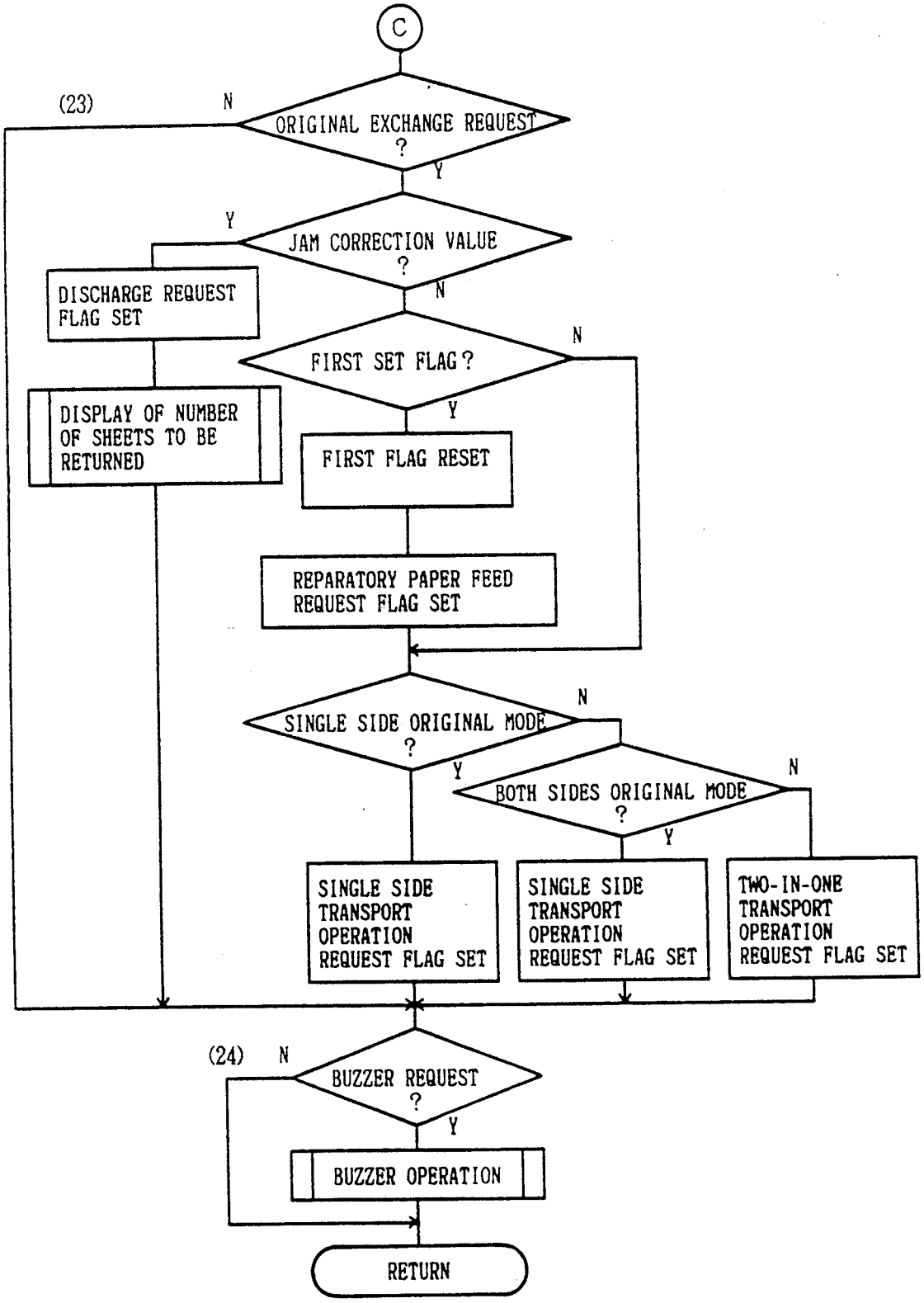
Figure 15:
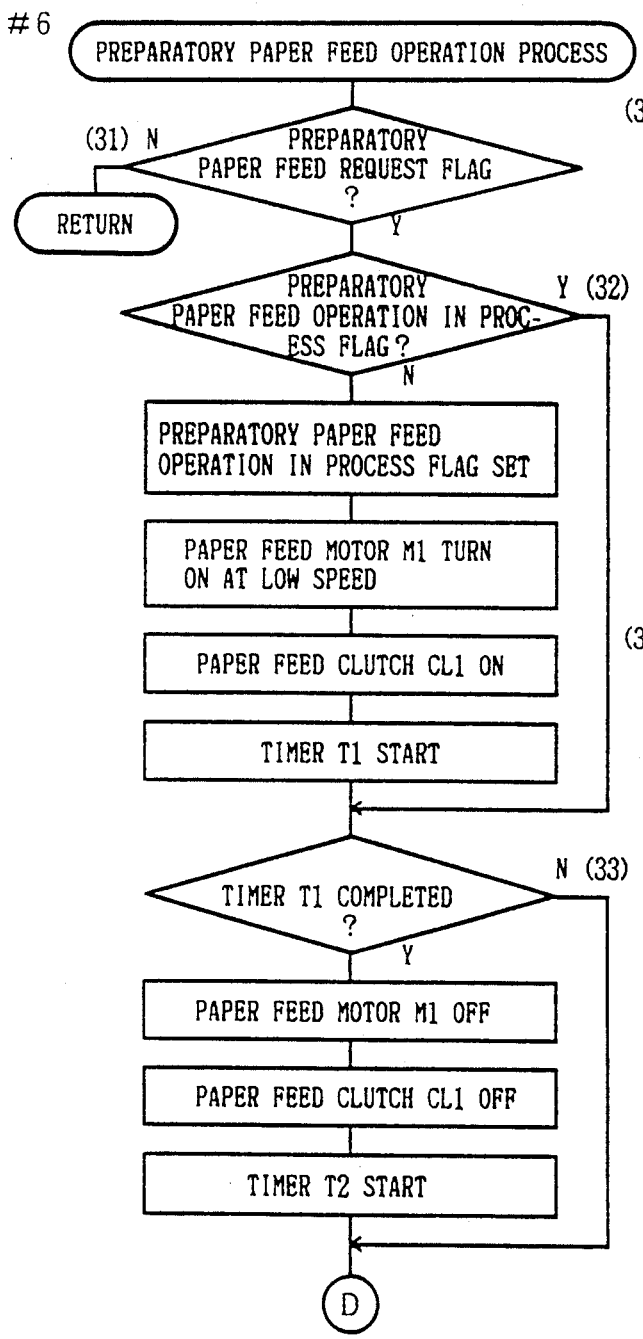
Figure 16:
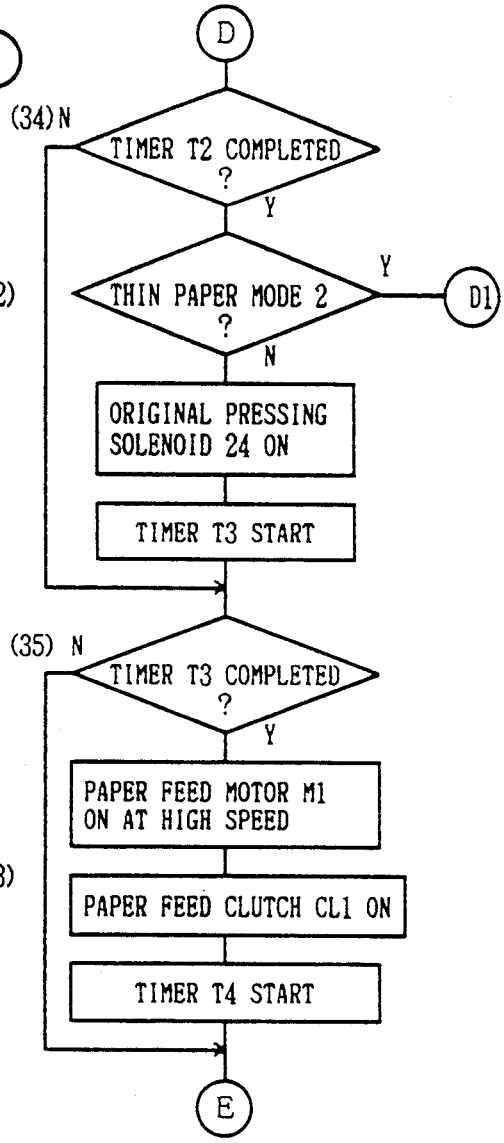

FIGS. 13 and 14 are flow charts showing subroutines of mode processing.

FIGS. 15 through 18 are flow charts showing subroutines of operational process for preparatory paper feeding.

Figure 19:
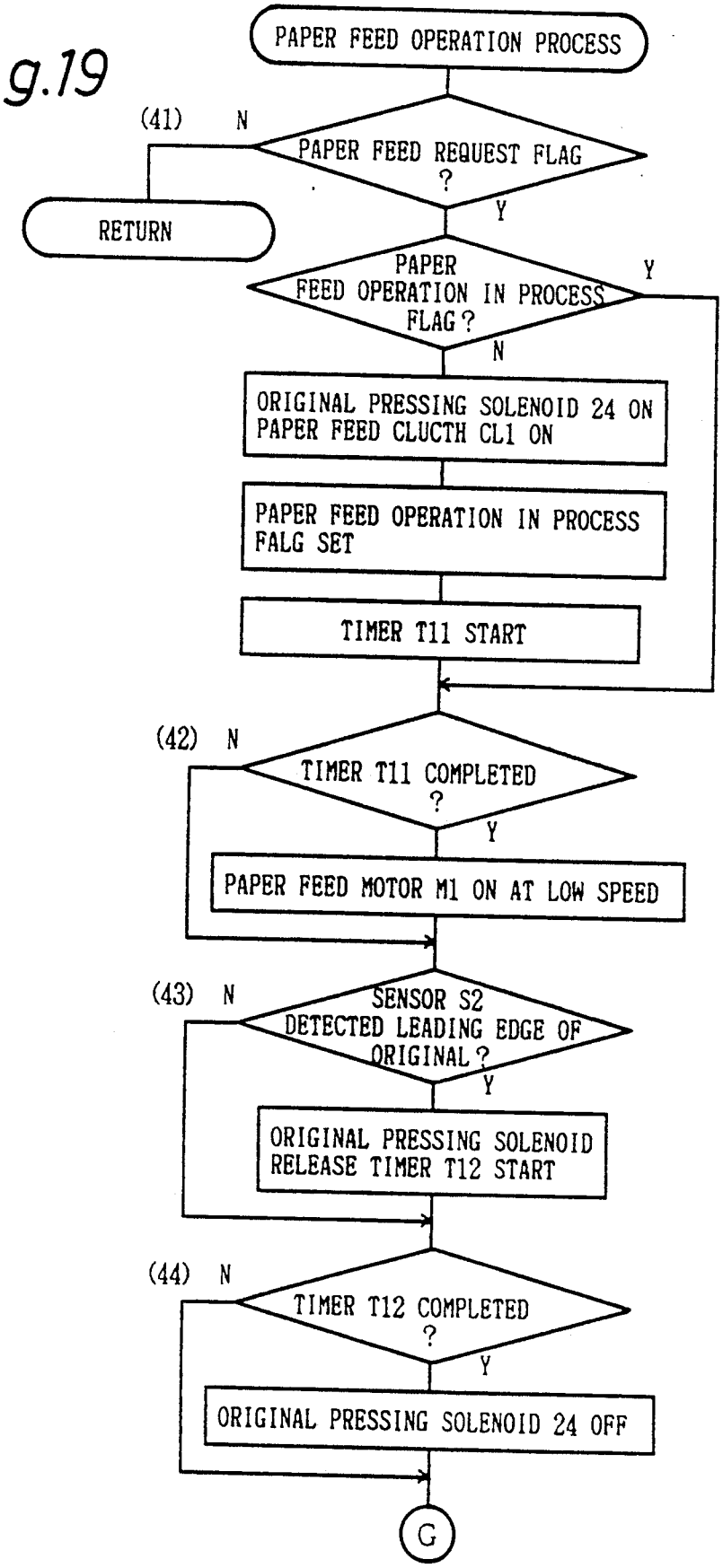
Figure 20:
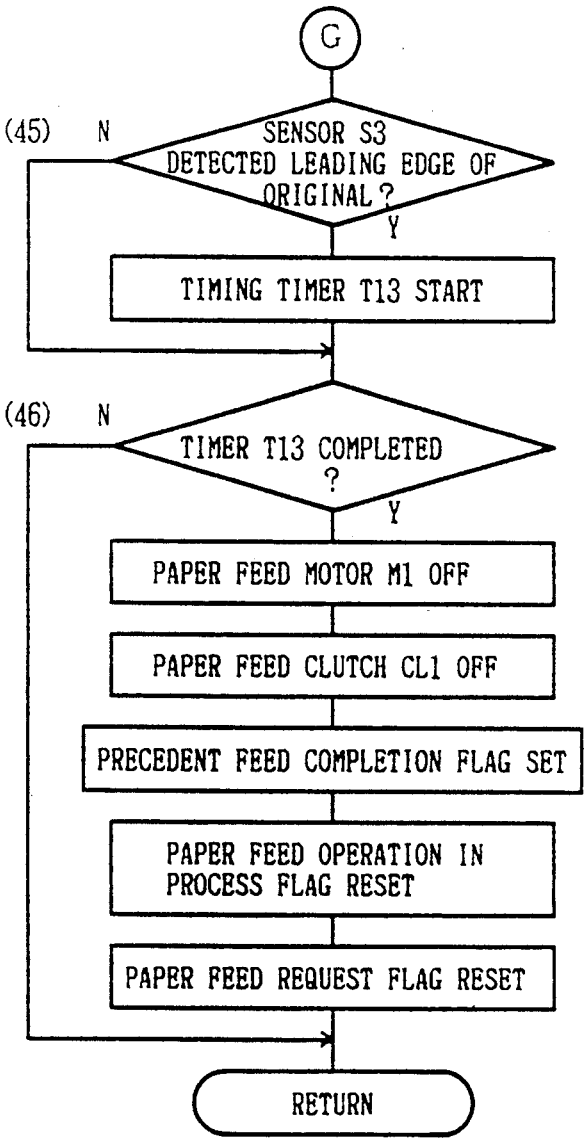
Figure 21:
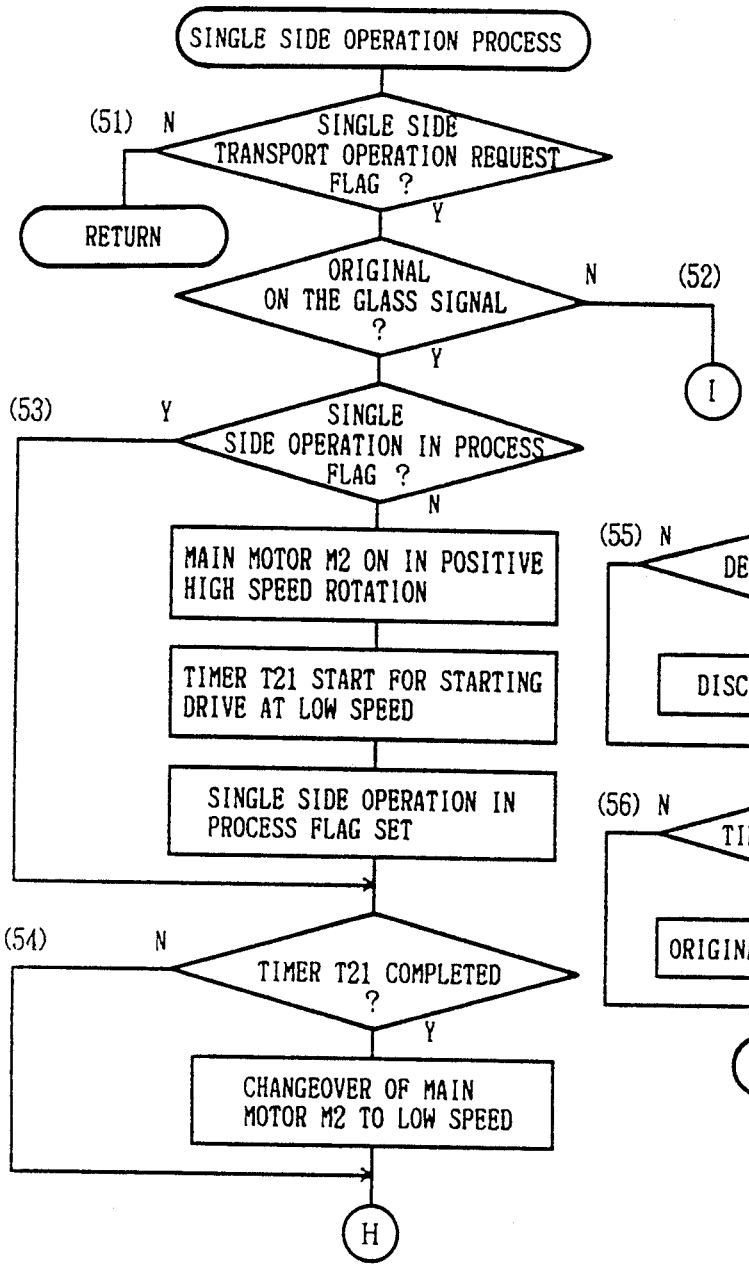
Figure 22:
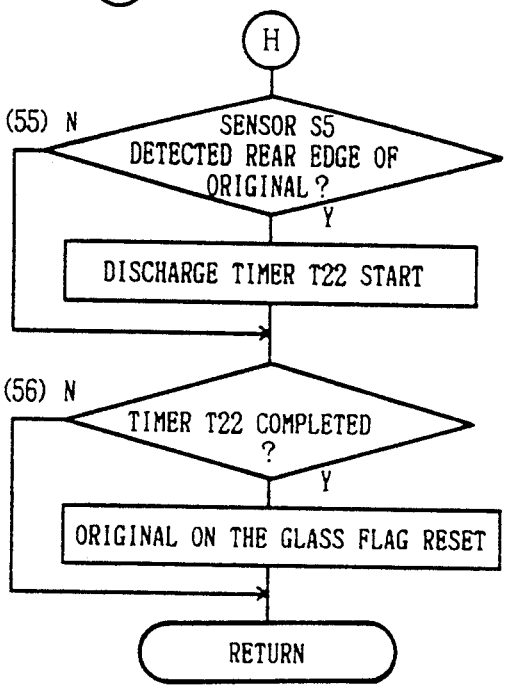
Figure 23:
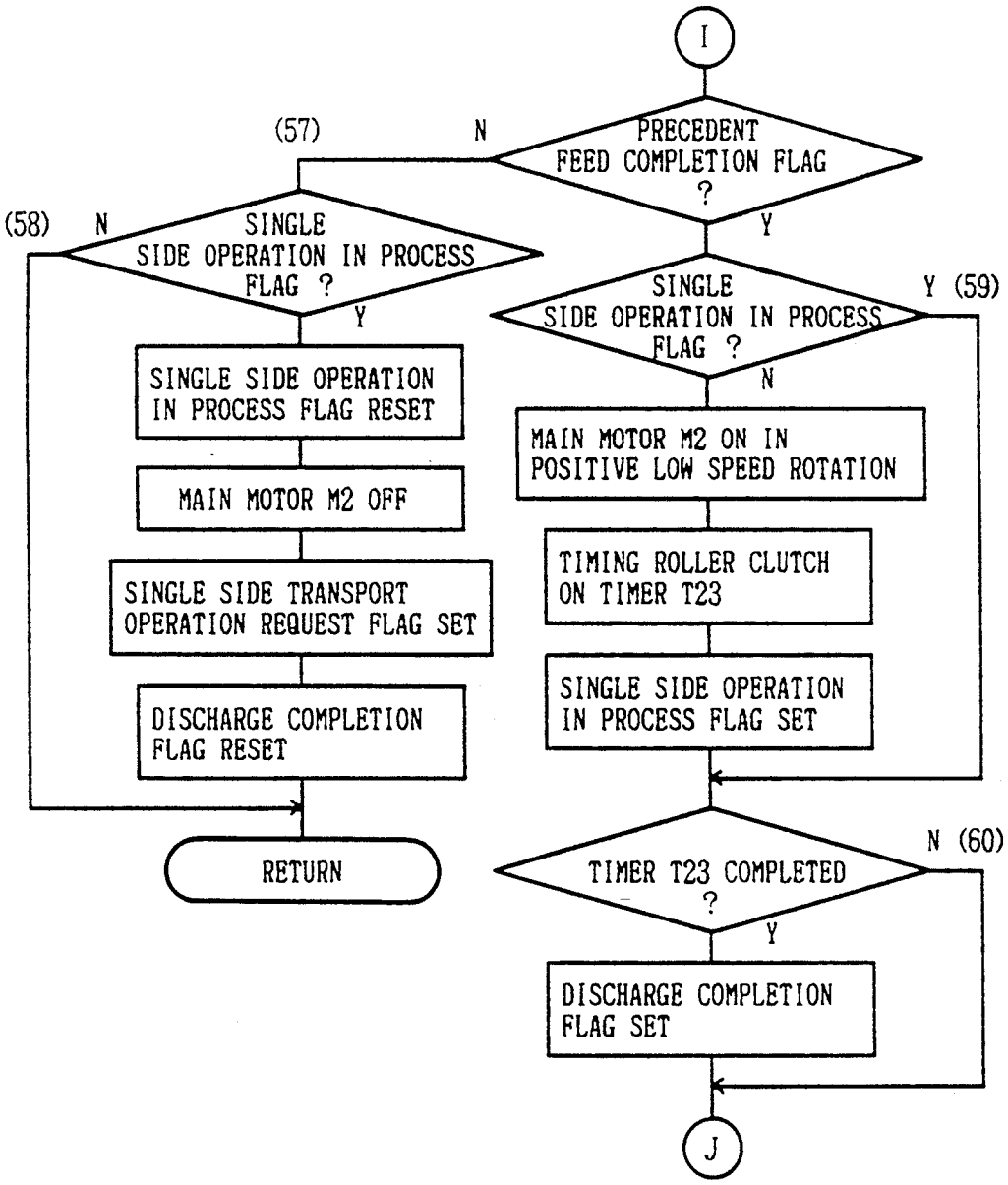
Figure 24:
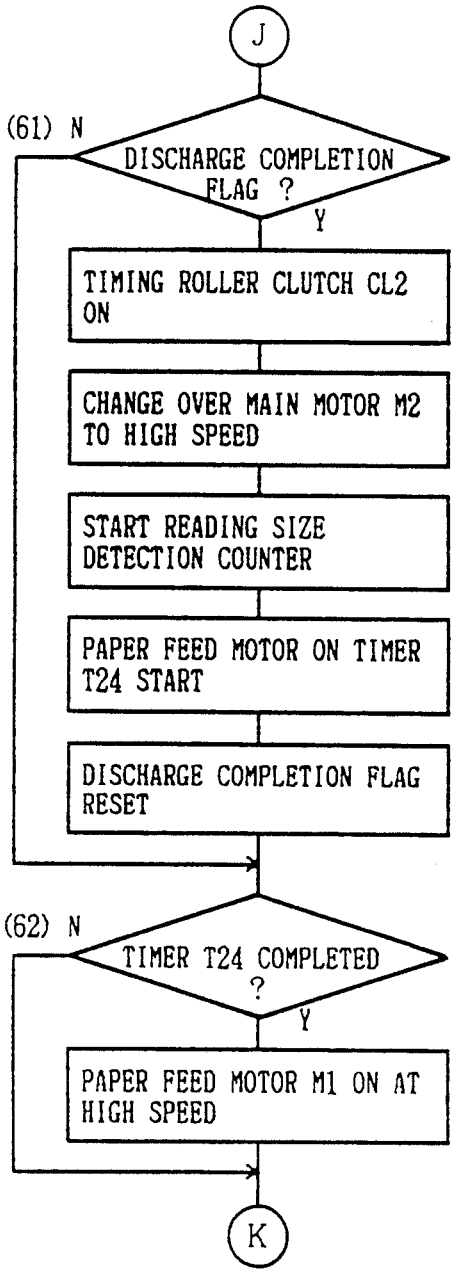
Figure 25:
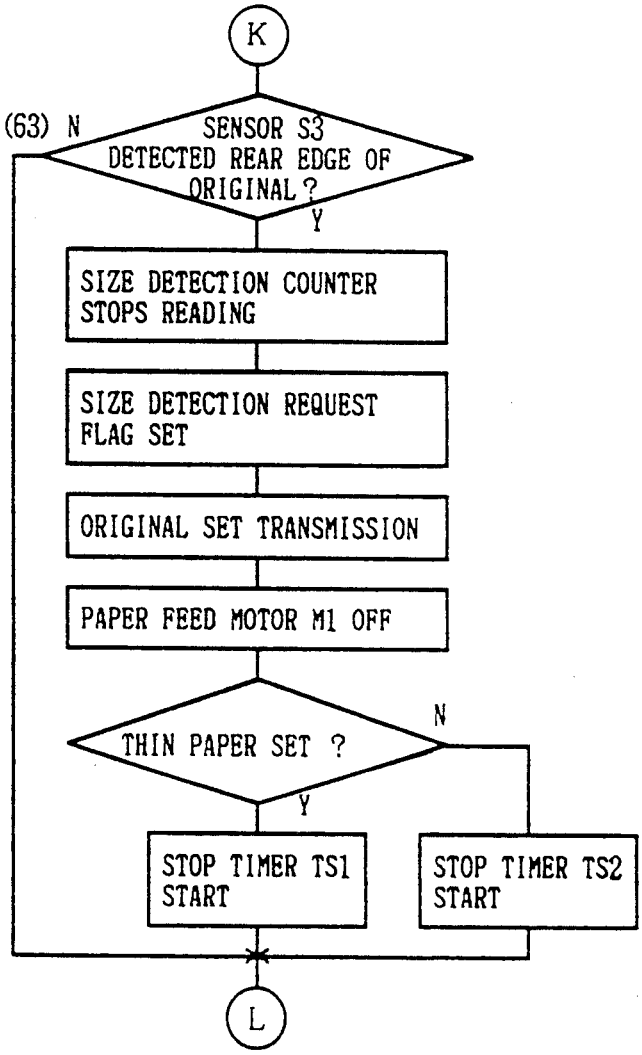
Figure 26:
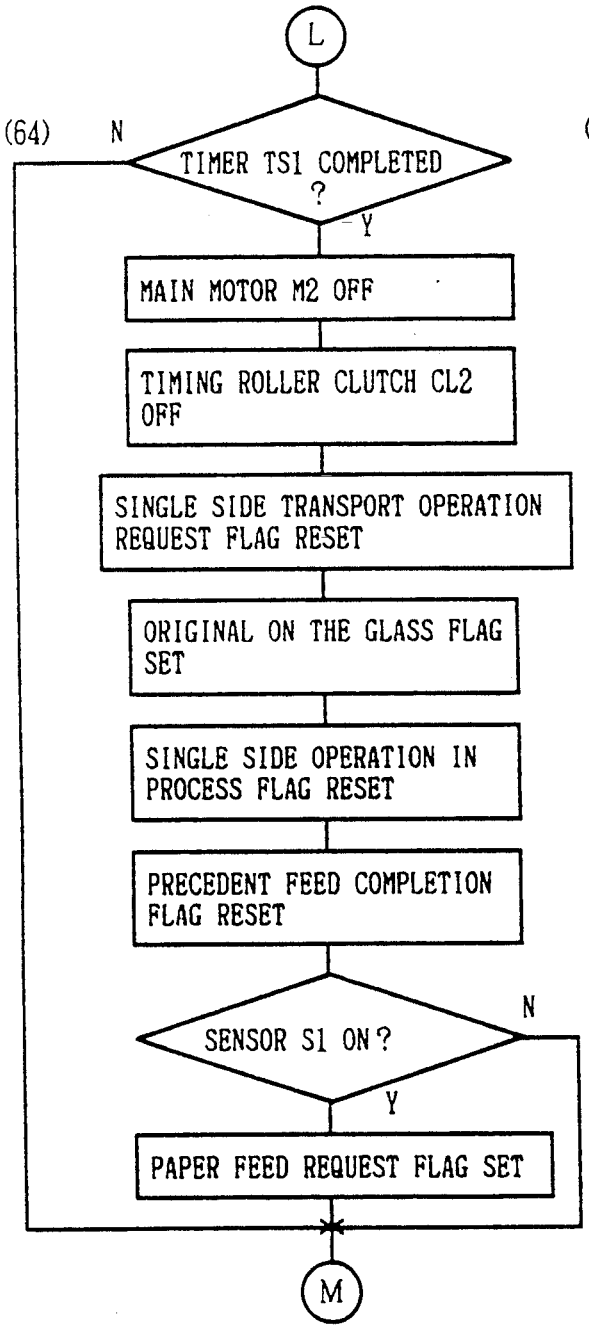
Figure 27:
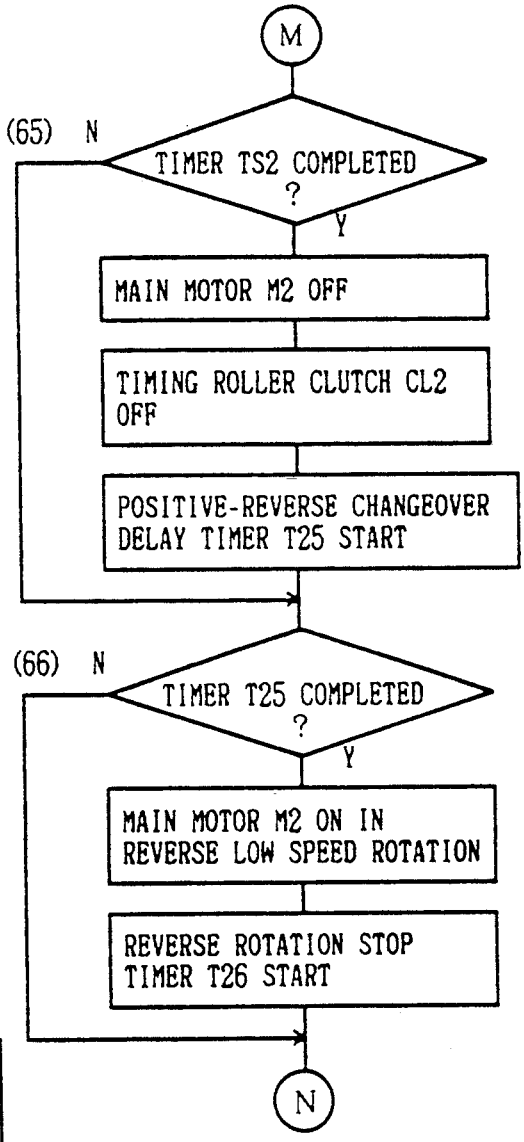
Figure 28:
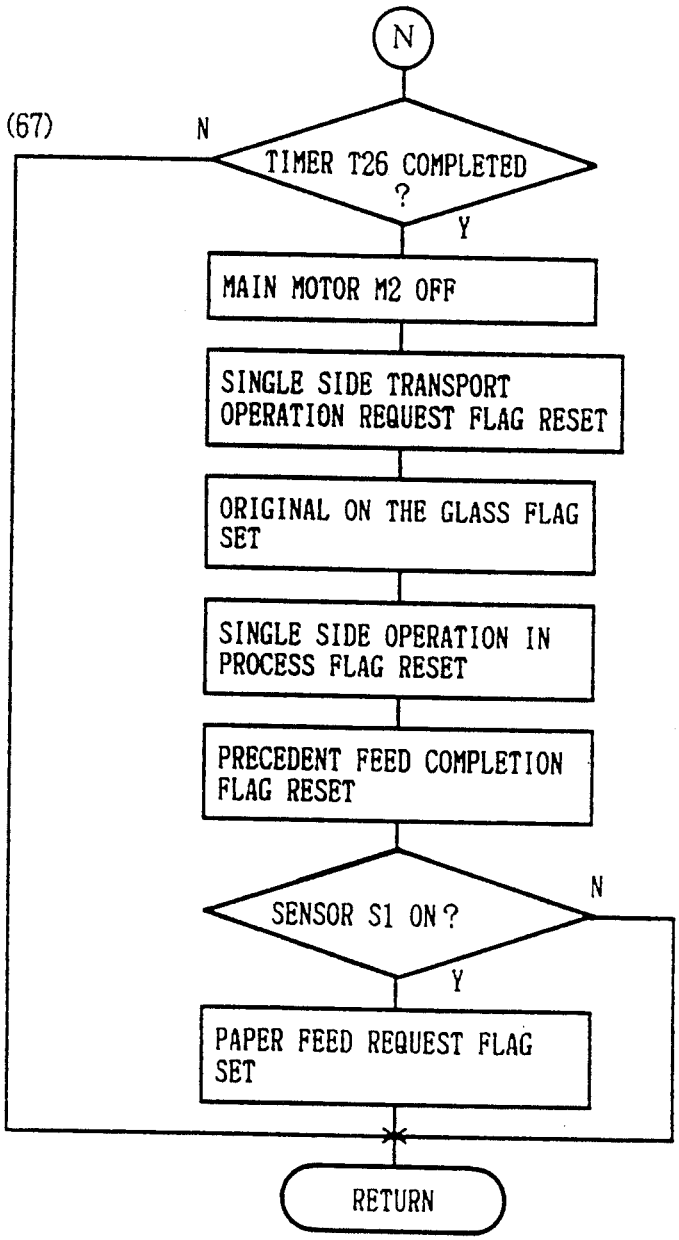
Figure 29:
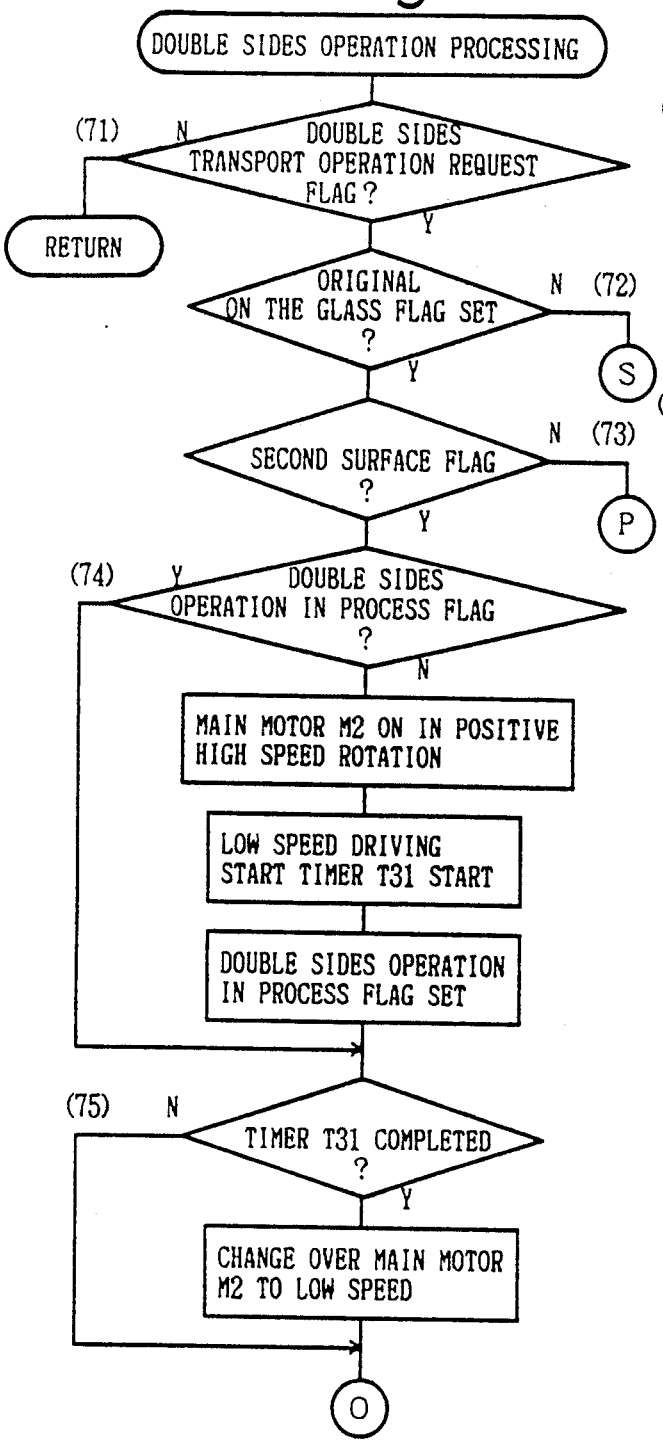
Figure 30:
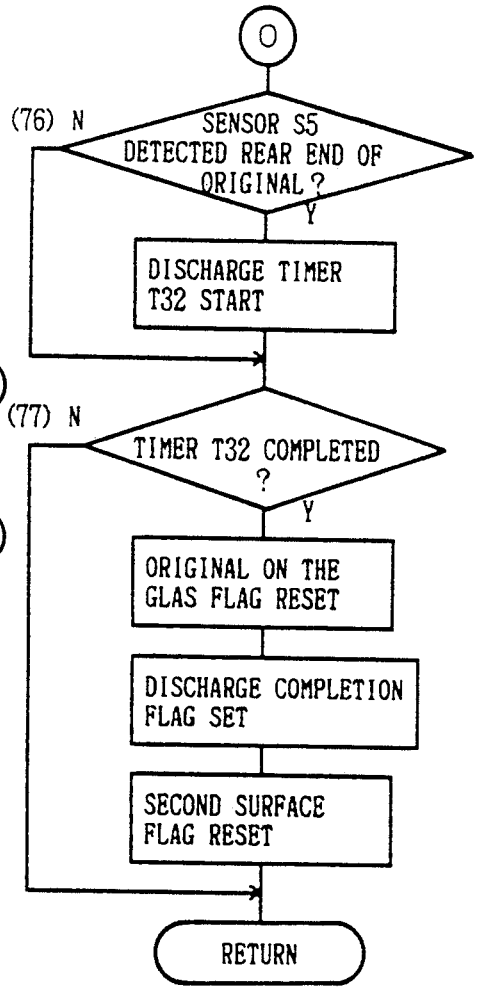
Figure 31:
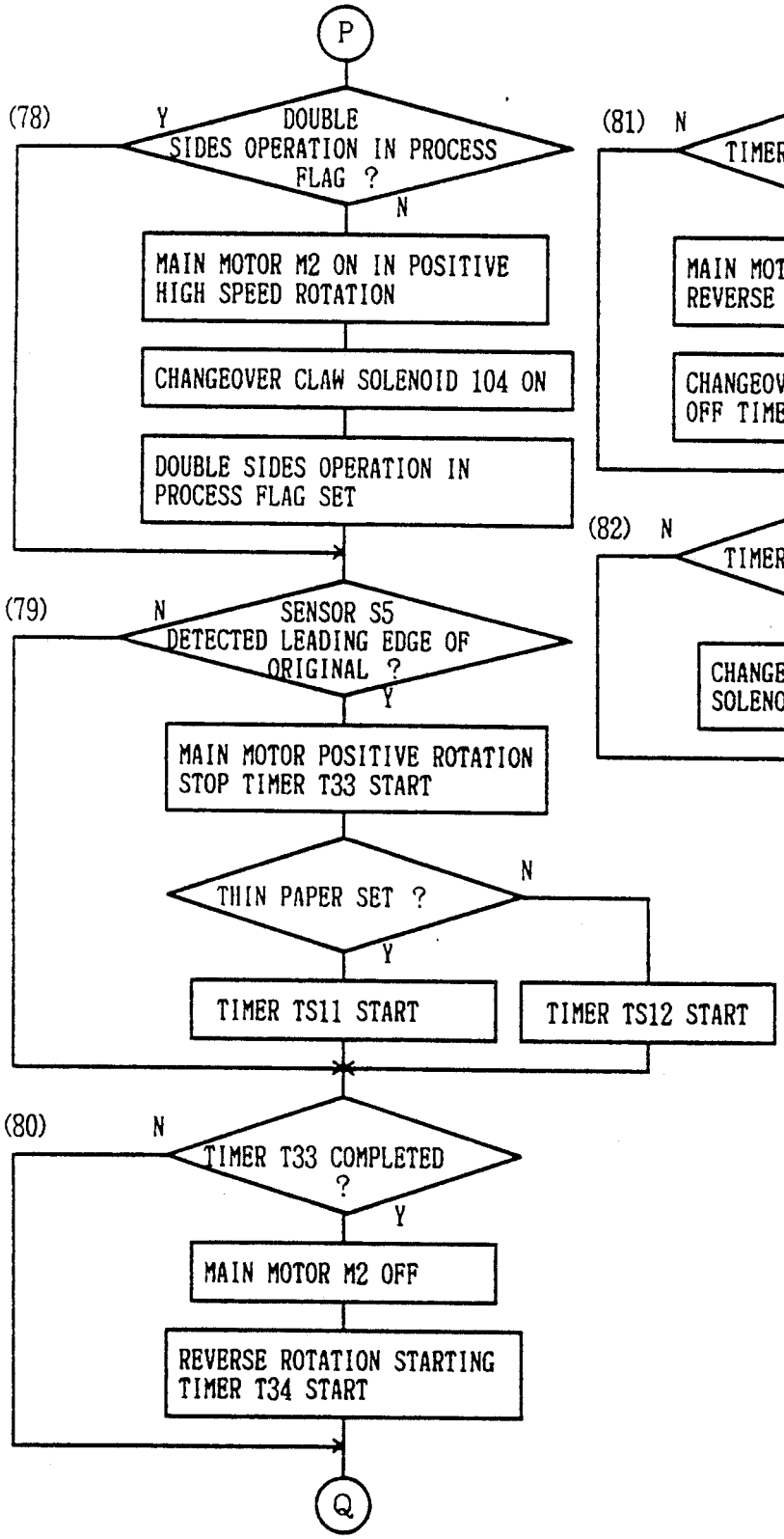
Figure 32:
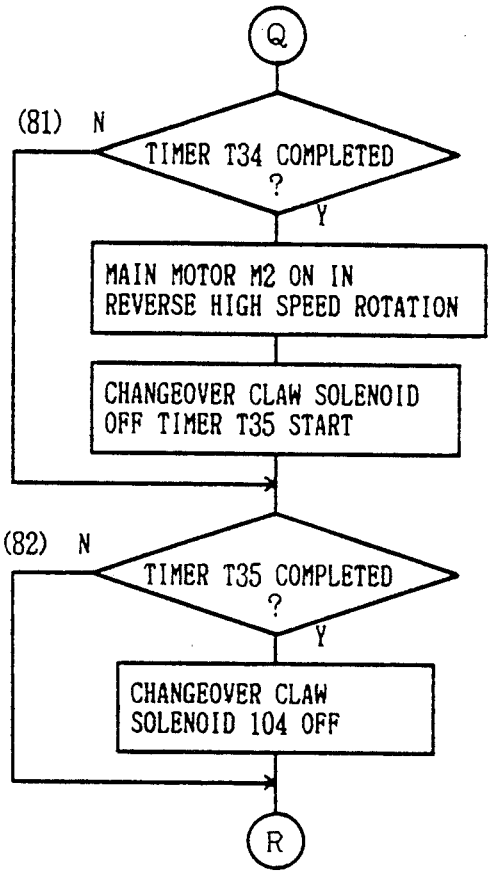
Figure 33:
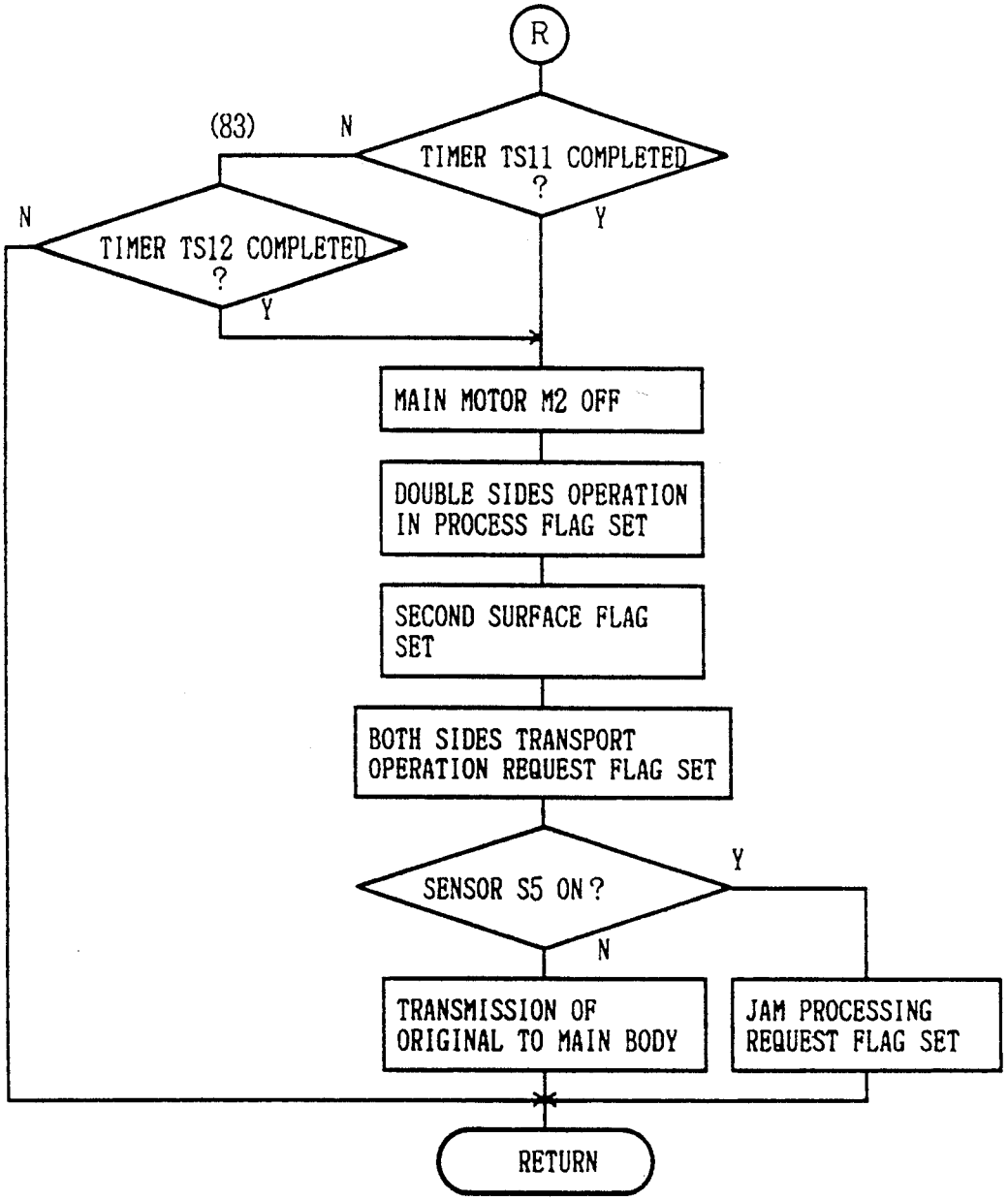
Figure 34:
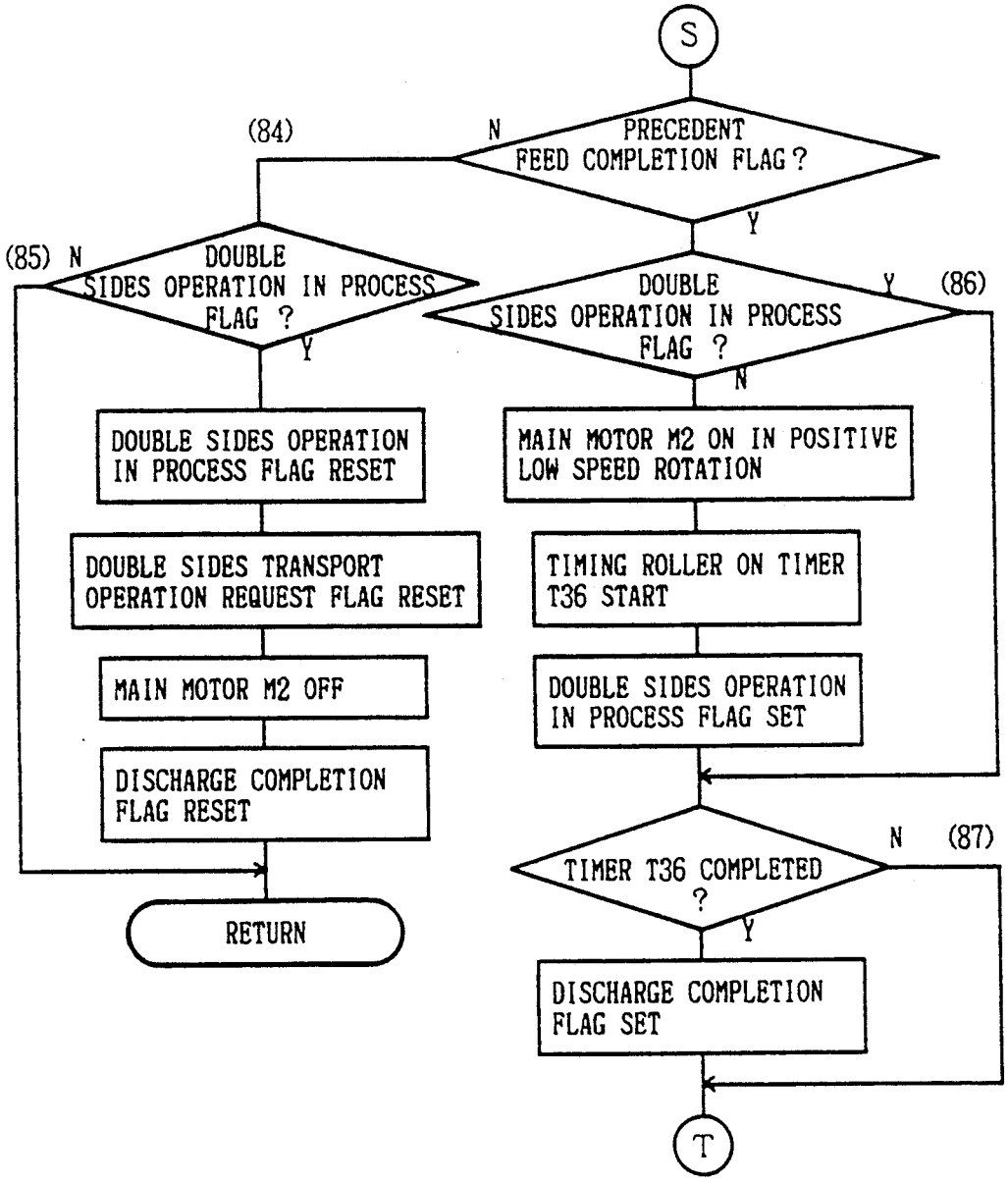
Figure 35:
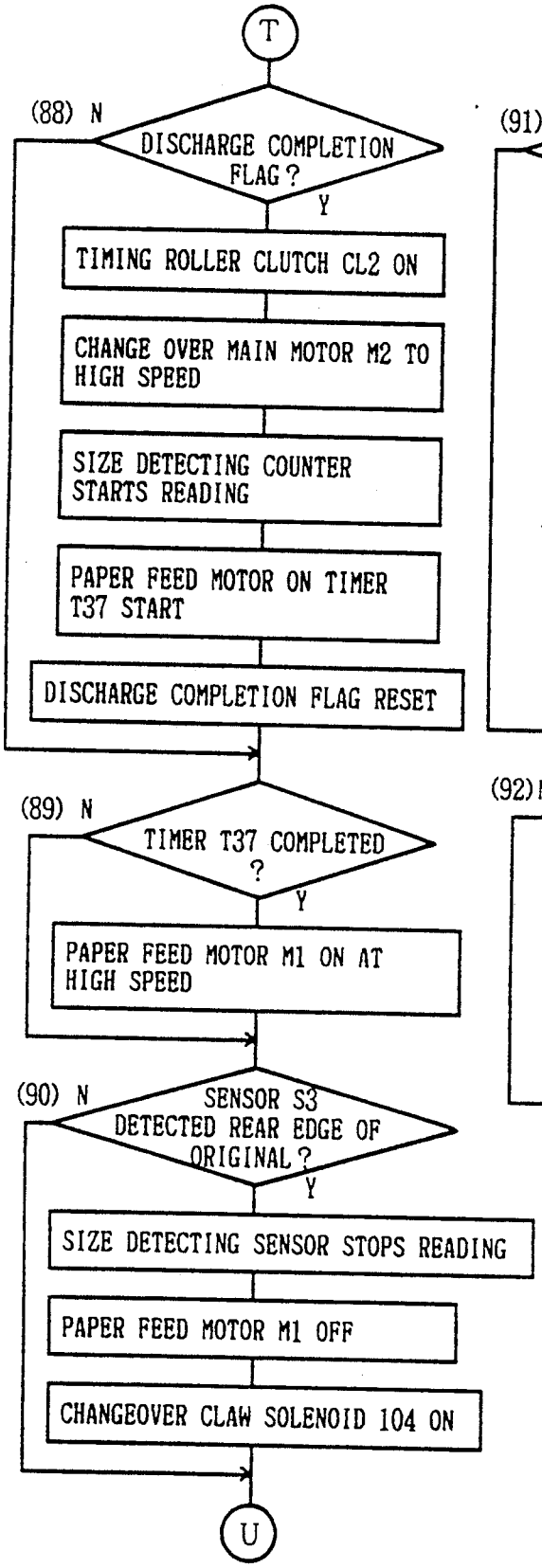
Figure 36:
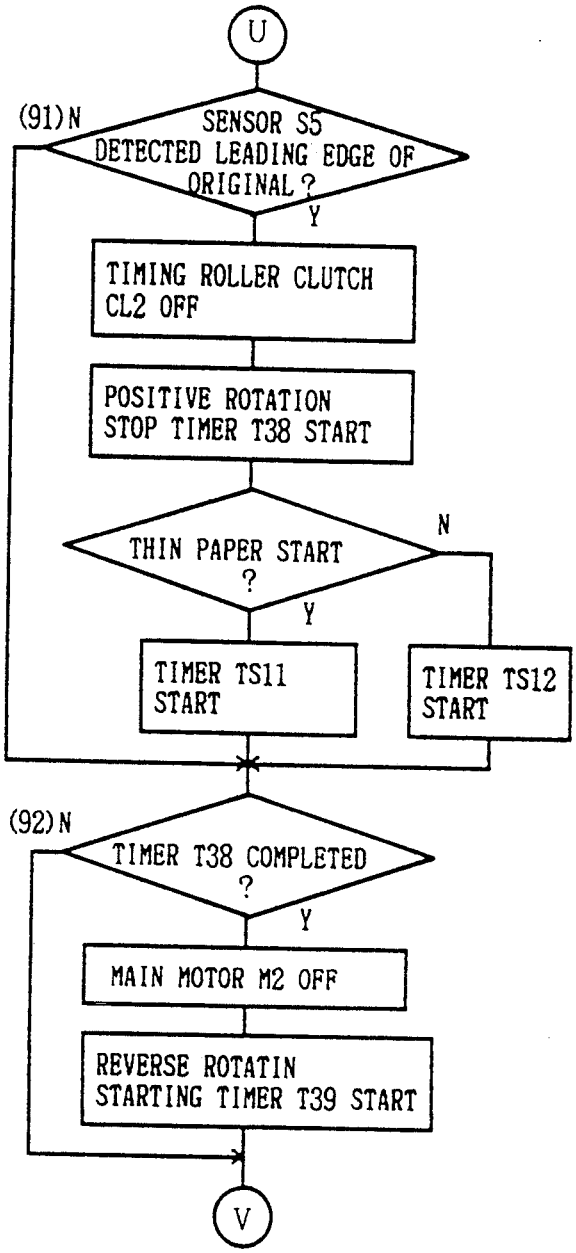
Figure 37:
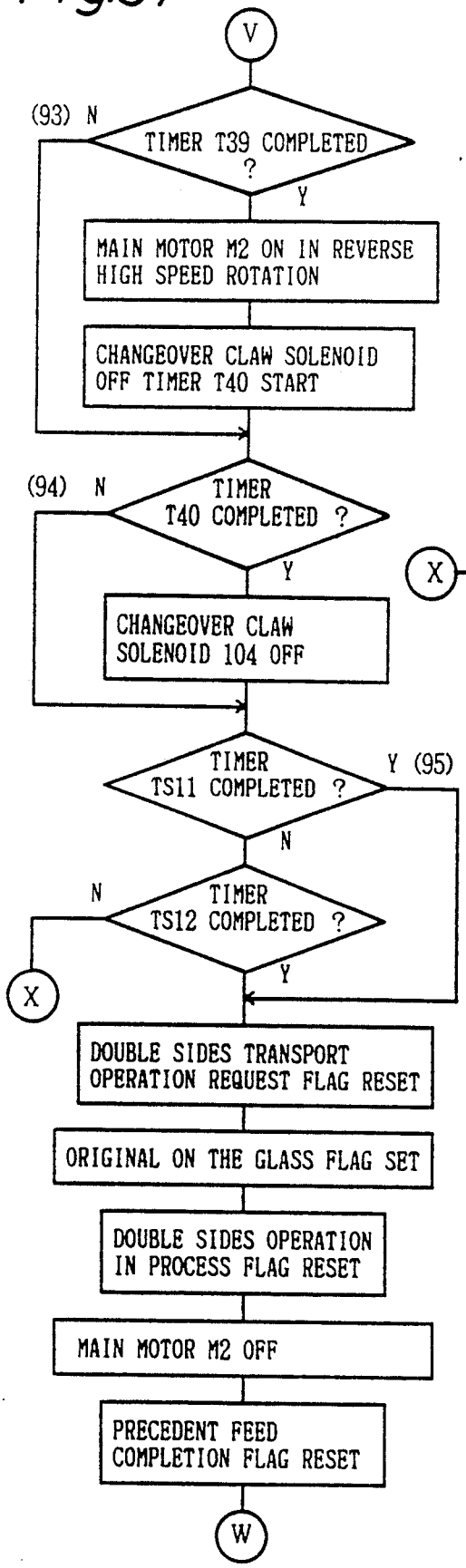
Figure 38:
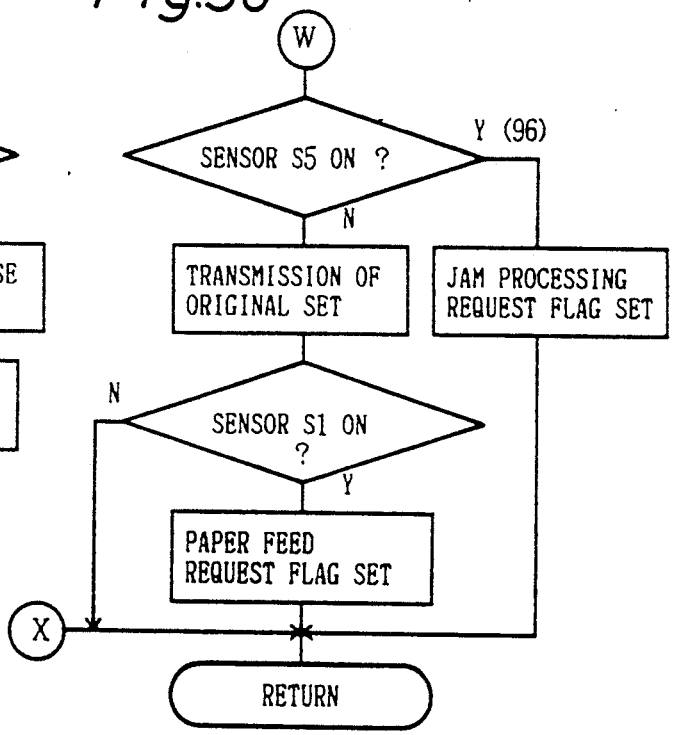
Figure 39:
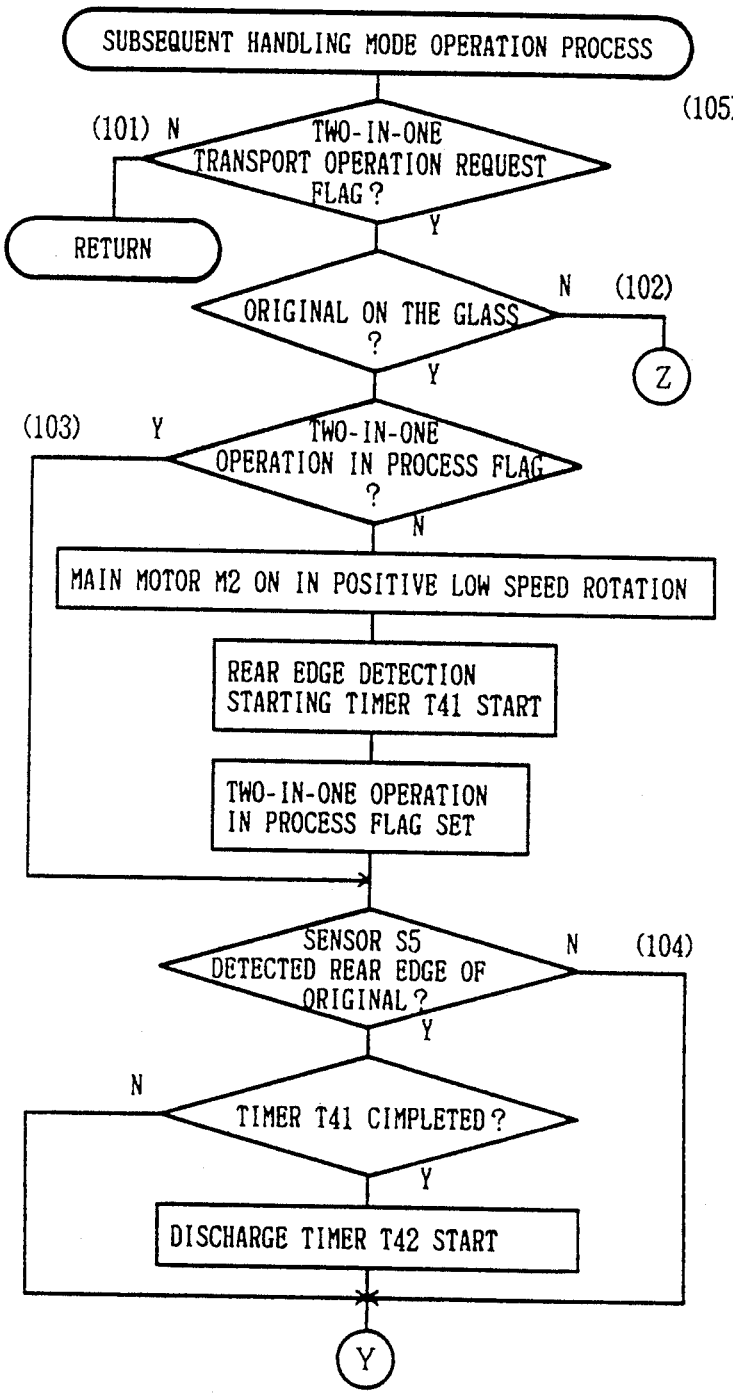
Figure 40:
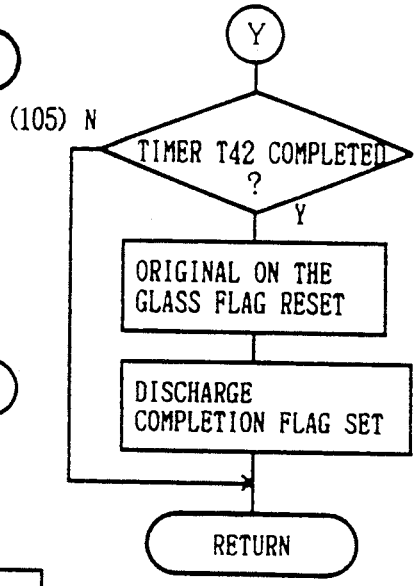
Figure 41:
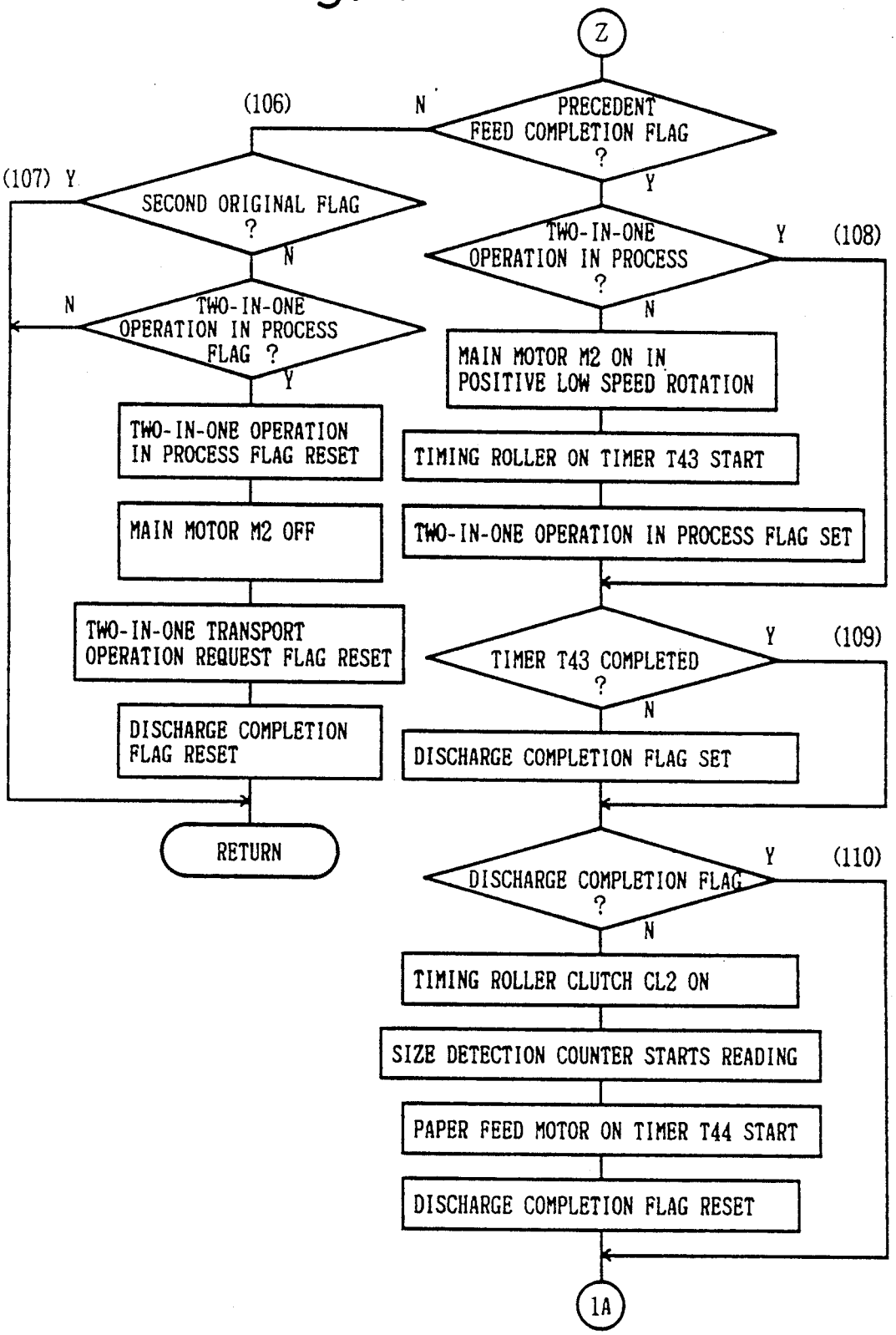
Figure 42:
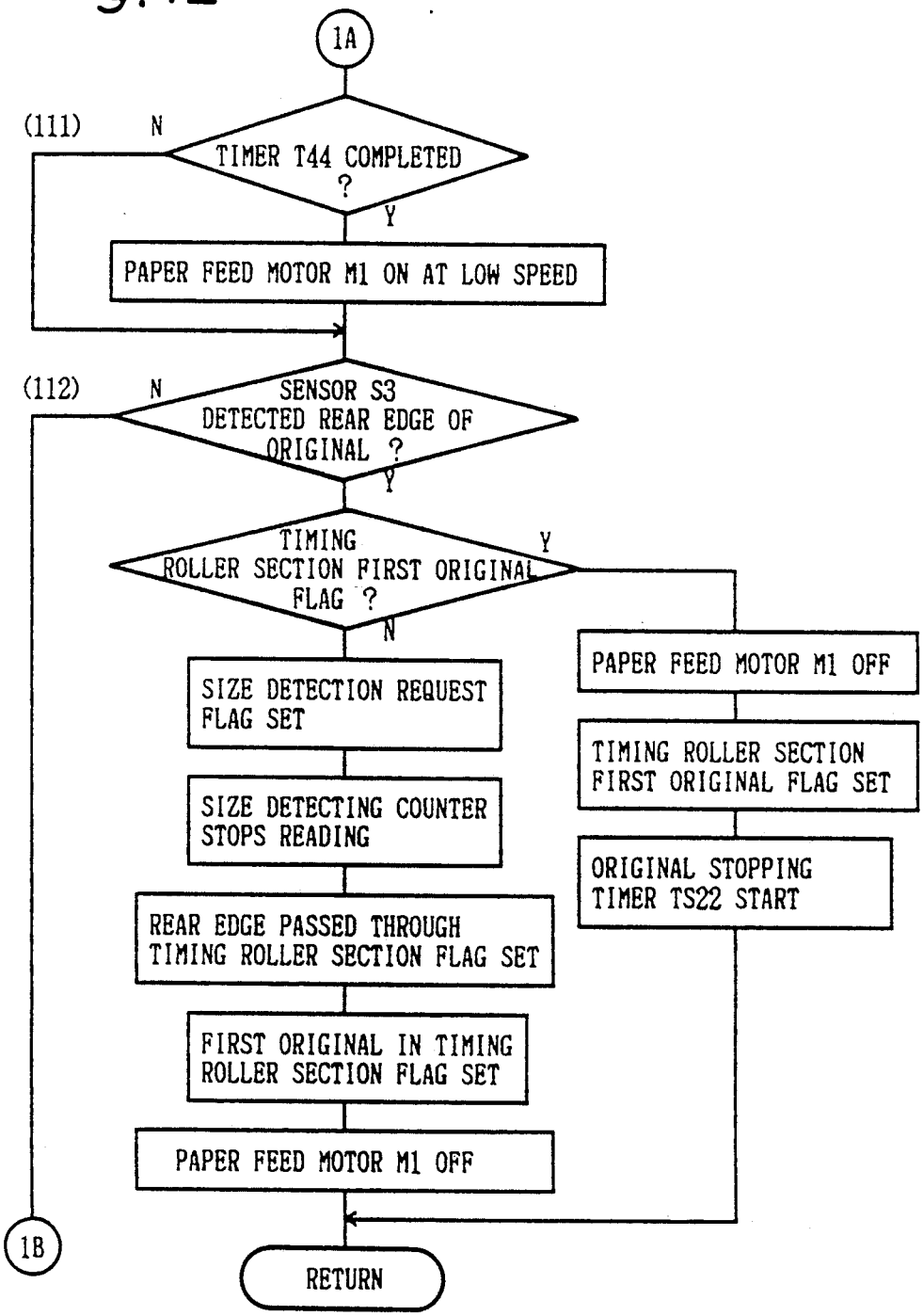
Figure 43:
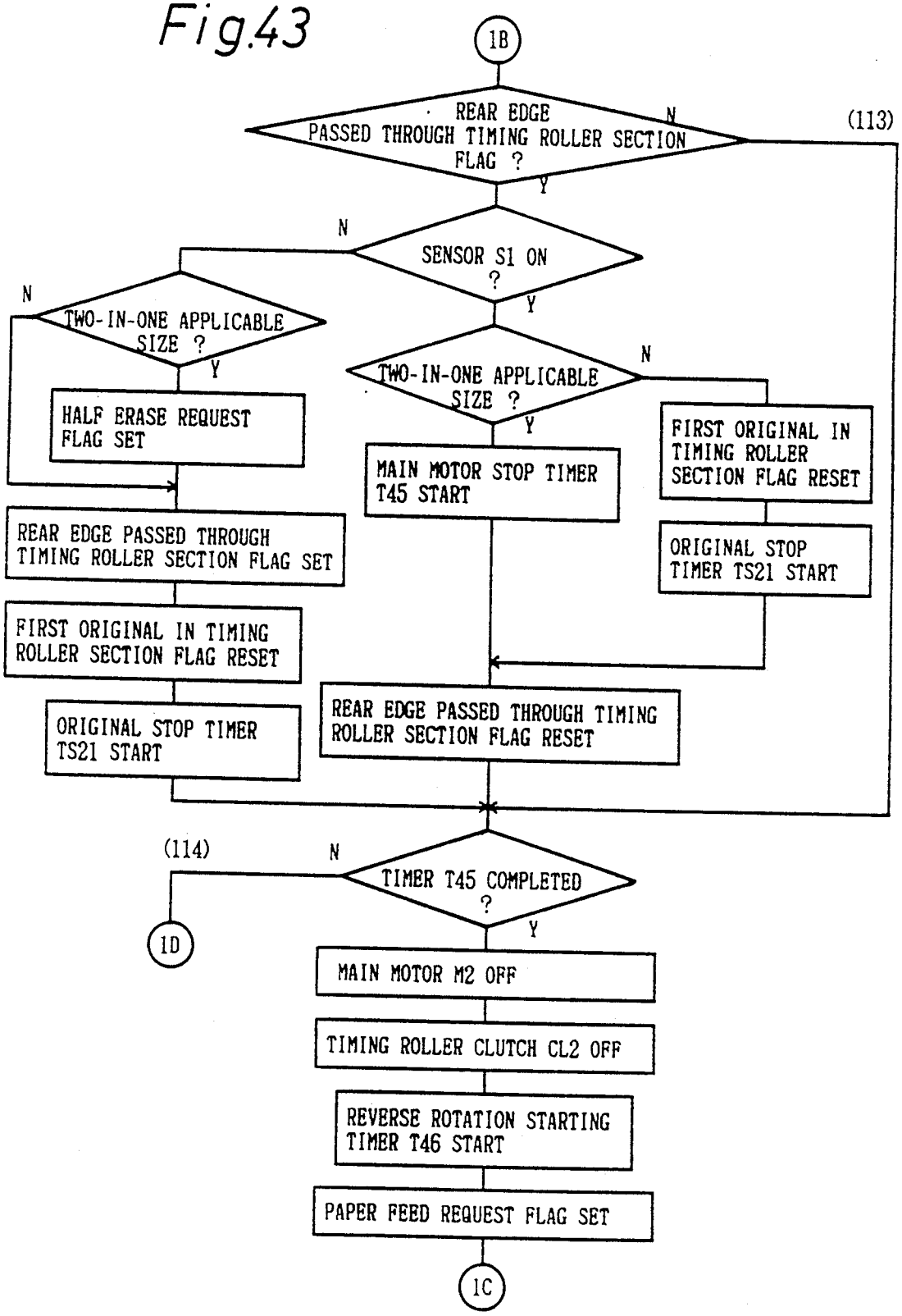
Figure 44:
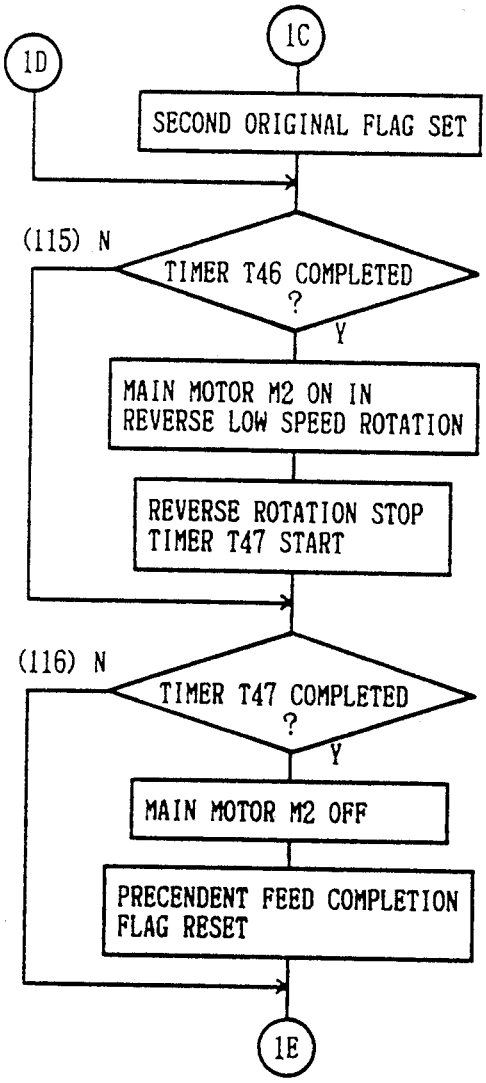
Figure 45:
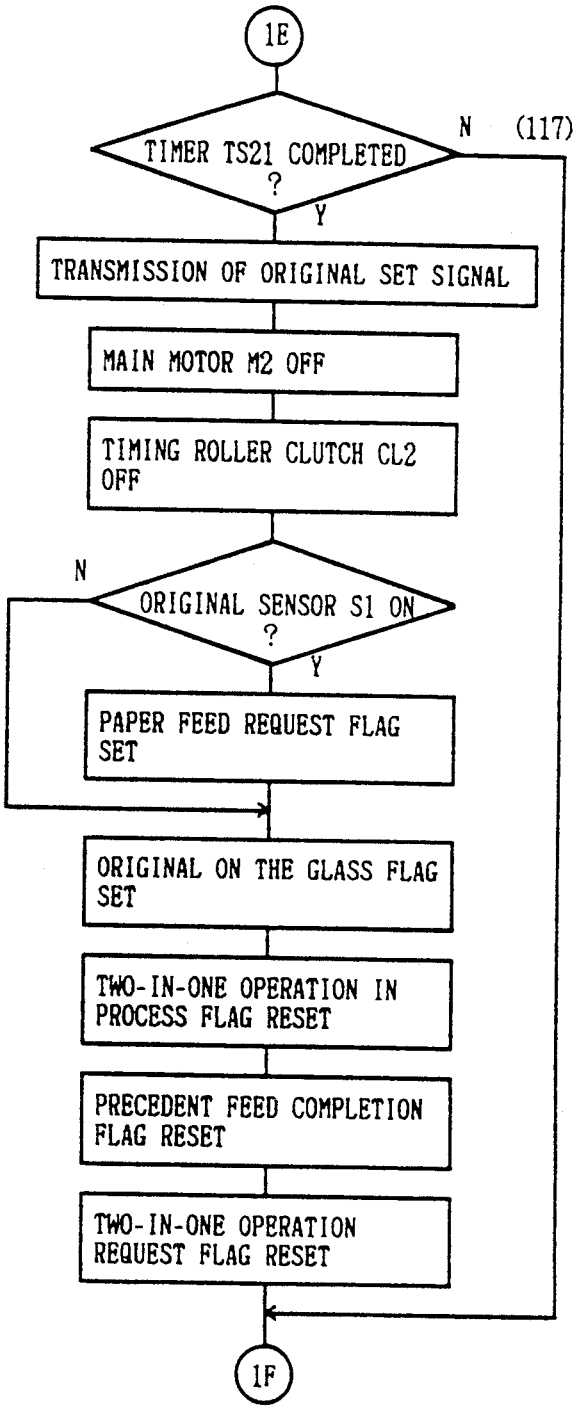
Figure 46:
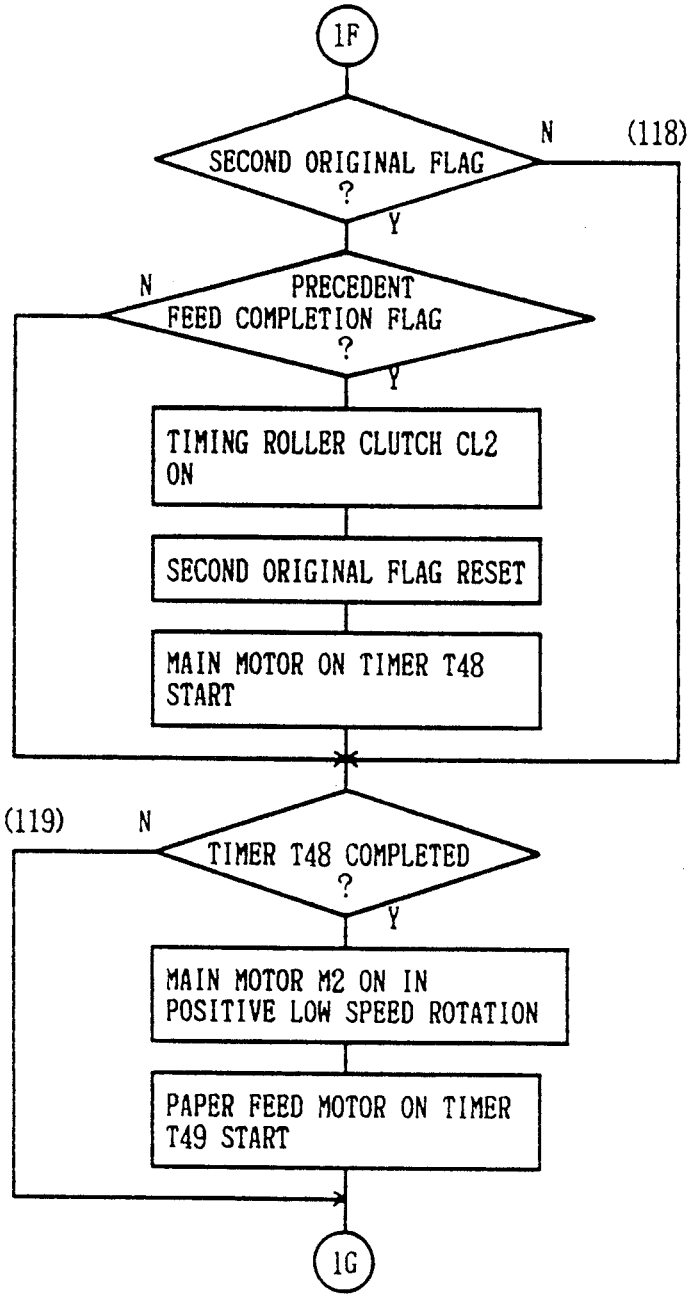
Figure 47:
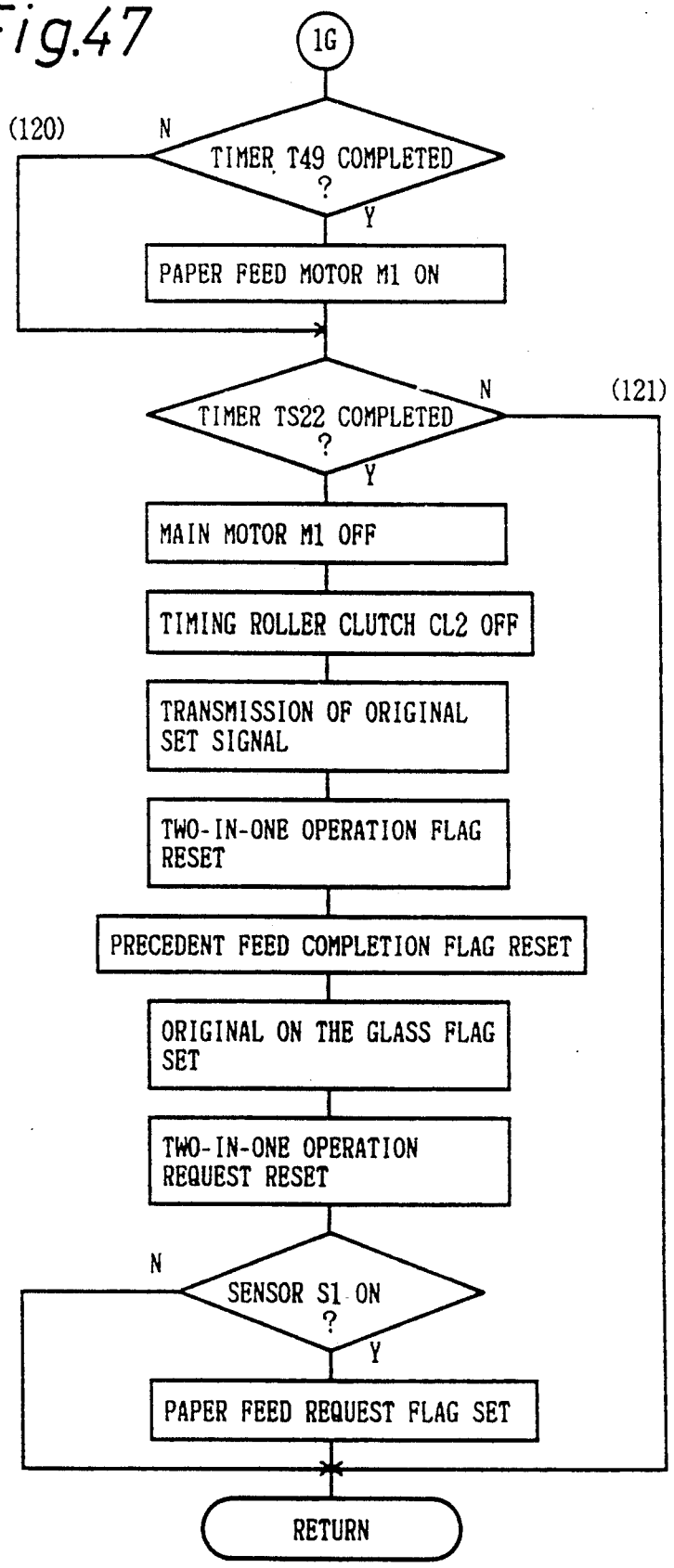

FIGS. 19 and 20 are flow charts showing subroutines of operational process for paper feeding.

FIGS. 21 through 28 are flow charts showing subroutines of single side operational process.

FIGS. 29 through 38 are flow charts showing subroutines of both sides operation process.

FIGS. 39 through 47 are flow charts showing subroutines of the two-in-one handling mode operation processing.

DESCRIPTION OF THE PREFERRED EMBODIMENT

An embodiment of the present invention will now be described below referring to FIGS. 3 through 47.

The embodiment shows a case in which the present invention is applied to a copying machine which is capable of performing both sides copying operation.

Figure 3:
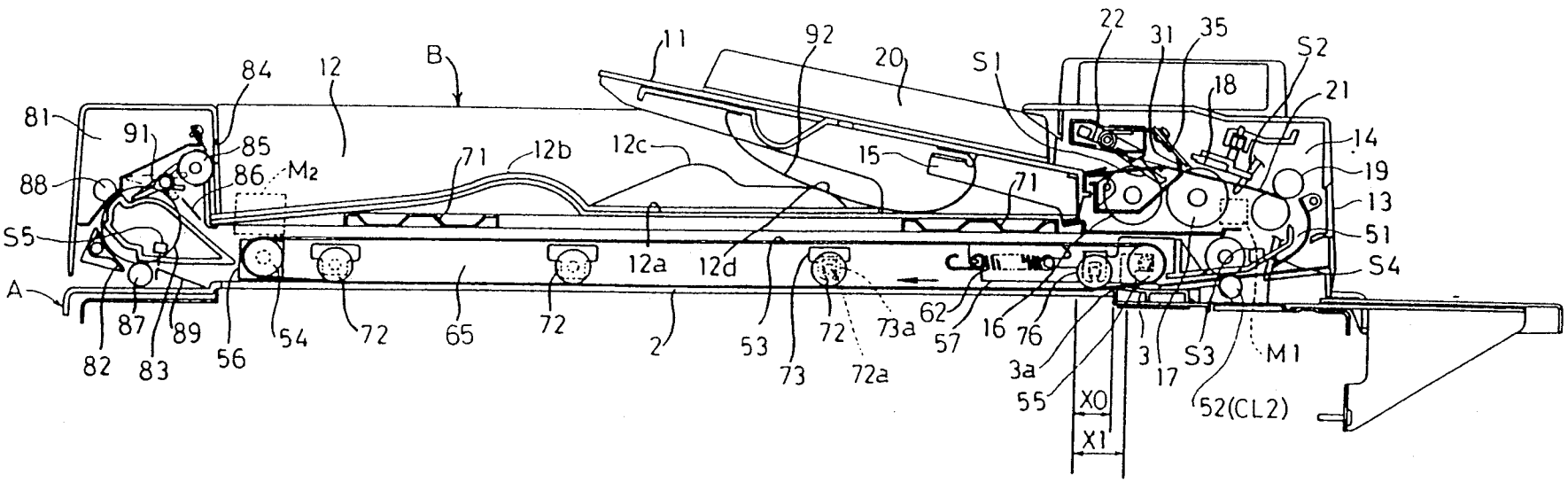
FIG. 3 is a vertical sectional front view showing the whole structure of a document feeding apparatus to which the present invention is applied.

As illustrated in FIG. 3, the copying machine A is provided with a platen glass 2 on the upper surface thereof. At one end portion of the platen glass 2, there is arranged a metal original scale 3. The original scale 3 is provided with graduations (not illustrated) to show the positions of each size of originals for use when originals are manually placed on the platen glass 2. The original scale 3 protrudes above the platen glass 2 to act as a positioning member for positioning an original. A reference numeral 3*a* shows a surface where an original is placed for positioning and it is always protruded above the platen glass 2 in this embodiment. It may, however, be arranged to protrude the surface whenever it is necessary to do so.

On the upper surface of the platen glass 2 in the copying machine, there is provided an original transport device B whose rear edge portion is linked with a hinge (not shown) for opening and closing. Since the original transport device B is freely opened and closed, it works as an original cover when the original is manually placed on the platen glass 2 for copying operation. Further, it may either feed an original automatically onto the platen glass 2 under the state the platen glass 2 is covered or discharge an original out of the platen glass 2.

The original transport device B is formed of two stage platforms of an original stack tray 11 arranged on its upper portion and an original discharge tray 12 arranged on the lower portion. The original discharge tray 12 forms as a recess on the upper surface of the main body of the machine 13 as illustrated in FIGS. 3 and 9, and it is arranged to take out an original from an outlet 13*b* left open on the front side.

On the right-hand side of the original discharge tray 12, there is provided a paper feeding section 14 to which the original stack tray 11 is attached by a bracket 15 with a falling gradient toward the paper feeding section 14. The original stack tray 11 is provided with a side guide 20 for centering which is movable corresponding to the size of original.

In the paper feeding section 14, there are sequentially provided along the lower paper feeding guide 21 extending from the original stack tray 11 a pick-up roller 16 for feeding originals stacked on the original stack tray 11 from the lowermost original, a separation roller 17 for separating and feeding the original fed from the lowermost original one by one, a separation section comprised of a separation pad 18 and a pair of feed rollers 19 for securely feeding originals passed through the separation section.

Figure 5:
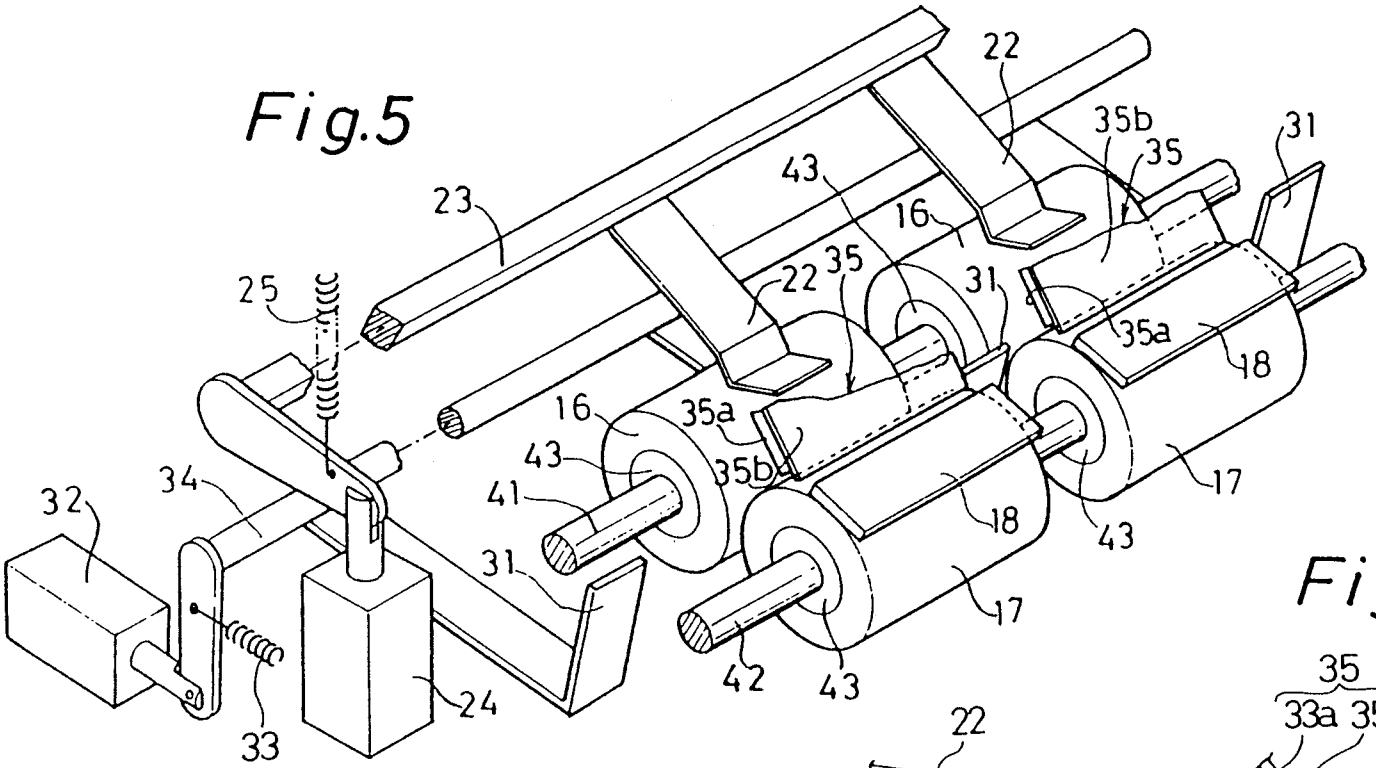
FIG. 5 is a perspective view of a main part of the feeding section.

At a position just in front of the separation roller 17, an original stopper 31 is provided. The original stopper 31 is fixed to a rotating shaft 34 actuated by a keep solenoid 32 (FIG. 5). Normally, the original stopper 31 is provided at an original receiving position projected above a guide 21 to function for receiving and adjusting the leading edge of originals properly. When the solenoid 32 is turned on, it is moved backward below the guide 21 against a spring 33.

The pick-up rollers 16 and the separation rollers 17 are made of rubber and are positioned immediately on both sides of center line of the original transport path (FIG. 5). Original pressing members 22 are provided above the pick-up rollers 16 on the right and left sides. The original pressing members 22 are made of leaf spring and attached to a rotating shaft 23. A solenoid 24 and a restoring spring 25 are actuated on the rotating shaft 23, and the rotating shaft 23 is held at a position where it can move the original pressing member 22 upward by energy of the ordinary spring 25, however, with the solenoid 24 turned on, it is moved so as to move the original pressing members 22 downward against the spring 25, by which the original pressing member 22 elastically presses an original on the original set tray 11 to the pick-up rollers 16 so that the pick-up rollers 16 surely functions to transport a lowermost original.

At an initial stage of starting paper feeding for the originals firstly set on the original tray 11, preparatory original transport operations are conducted by weak transporting force and strong transporting force for a predetermined period of time respectively at a state the original stopper 31 is moved upward to the position where original is received and stopped thereat. Accordingly, even if an original placed undermost is not set properly at the position by interference of the pick-up roller 16, the original placed lowermost is surely sent to the position of the original stopper 31 by the preparatory transport and all the originals set therein are properly arranged. At this stage, the original stopper 31 is moved downward to be ready for feeding originals. At the time when a preparatory original transport is conducted with weak transporting force, it is arranged to sufficiently position and arrange originals of thin paper, and at the next preparatory original transport with strong transporting force, it is arranged to surely position and arrange originals of thick paper which is hard to be arranged.

Figure 5A:
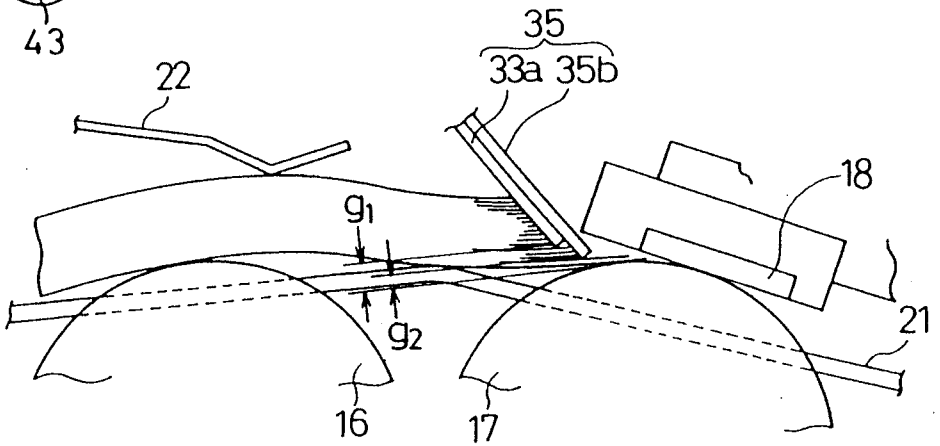

A front separation plate 35 is provided between the original stopper 31 and the separation section. The front separation plate 35 is fixed with a falling gradient toward the surface of the separation roller 17 extending from this side of the separation section, and the leading edge is positioned close to the portion where the separation pad 18 of the separation roller 17 is in contact with. The front separation plate 35 comprises a metal base plate 35*a* and a resin upper plate 35*b* which is lain on top of the base plate 35*a*. The upper plate 35*b* forms a gap g2 between the separation roller 17 necessary for paper feeding. The base plate 35*a* forms a bigger gap g1 than that of the upper plate 35*a* between the separation roller 17. As it is clearly shown in the FIG. 5*a*, there are formed regulating portions arranged in tiers at the base plate 35*a* and the upper plate 35*b* with a first tier regulating portion for giving a bigger paper feed gap g1 and a second tier regulating position for giving a smaller paper feed gap g2. The front separation plate 35 thus guides the edge of a group of originals arranged in contact with the original stopper 31 by the preparatory transport operation along the back sides of the base plate 35*a* and the upper plate 35 and transports the lower most original ahead of the others. The lowermost original then easily passes through a little wider gap g1 between the base plate 35*a* and the separation roller 17. However, since the number of originals are too many to be sufficiently separated, they are regulated at the smaller gap g2 between the upper plate 35*b* and the separation roller 17, and a proper number of originals are passed through the separation section. At this time, the number of originals separated by the base plate 35*a* is so small that they can be separated easily, and even if they are not sufficiently separated, a proper number of originals can pass through therebetween by an evasion of the flexibility of the upper plate 35*b*. Accordingly, by the front separation plate 35, a group of originals can be separated in comparatively small number to surely send them out. The degree of flexibility of the upper plate 35*b* may freely be selected by setting the thickness and material.

The separation pad 18 is made of rubber in large coefficient of friction and is inlaid in a part of the undersurface of a pad holder 36 and is energized together with the pad holder 36 by a spring 37 to get in contact with the separation roller 17. When a small number of originals passed through the front separation plate 35 are transported to the separation section, only the lowermost original in contact with the separation roller 17 having large transporting force is separated to pass through therebetween.

The original pressing member 22, front separation plate 35 and separation pad 18 are positioned on the center lines of each pick-up roller 16 and separation roller 17 aligned in front and in the rear on the right and left sides of the center line, and functions to surely activate the original which receives strong transporting force of the rollers 16 and 17. Since the points of action are symmetrically positioned on the right and left sides with the center line as a border, it protects the original from being skewed.

The pair of feed rollers functions as straight roller and they hold a sheet of original on its overall width sent out of the separation section. At the time when a sheet of original is sent to the feed roller 19, the pick-up roller 16 and separation roller 17 are stopped in order to obstruct a feeding of new original from the original stack tray 11. In this embodiment, the pick-up roller 16, separation roller 17 and the pair of feed rollers 19 are, therefore, arranged to be driven by a paper feed motor M1 (FIG. 1), and on the driving shaft of the separation roller 17, a magnet clutch CL1 (FIG. 4) is provided to properly stop the drive of the separation roller 17 and the pick-up roller 16 which correlatively act with the separation roller. Between the pick-up roller 16 and its driving shaft 41 and also between the separation roller 17 and its driving shaft 42, there are provided one way clutches 43 so that even if the pick-up roller 16 and separation roller 17 are stopped, as long as an original being transported by the feed roller 19 is kept in contact, it gives no resistance to the transporting operation of the originals by racing.

At the portion of the pick-up roller 16, there is provided an empty sensor S1 to detect whether or not originals are set in the original set tray 11 so as to enable ADF operation by detecting the originals. At close behind the separation section, there is provided a paper feed sensor S2 for detecting originals being sent out of the separation section, and after a predetermined period of time during which the original is taken into the pair of feed rollers 19, the original pressing member 22 is moved upward, while the magnet clutch CL1 is turned off to cut off the drive of the pick-up roller 16 and separation roller 17.

At the back of the feed roller 19, there is provided a U-turn path 51 to guide the original being fed onto the platen glass 2 from this side of the original scale 3. At the portion near the original scale 3 on the U-turn path 51, a pair of timing rollers 52 is arranged. There is also provided a transport belt 53 positioned on the original scale 3 and platen glass 2 following the U-turn path 51.

The pair of timing rollers 52 and the transport belt 53 are driven by a main motor M2 which reversibly rotates. However, the timing roller 52 is independently stopped apart from the transport belt 53 by turning on and off of the magnet clutch CL2 arranged in its transmission system. The timing roller 52 temporarily receives an original sent from the feed roller 19 under its suspended state so that the leading edge of the original is adjusted at its nip section to correct skewed state of the originals. Thereafter, the pair of timing rollers 52 forwards the skew corrected originals onto the transport belt 53 being continuously driven.

Figure 4:
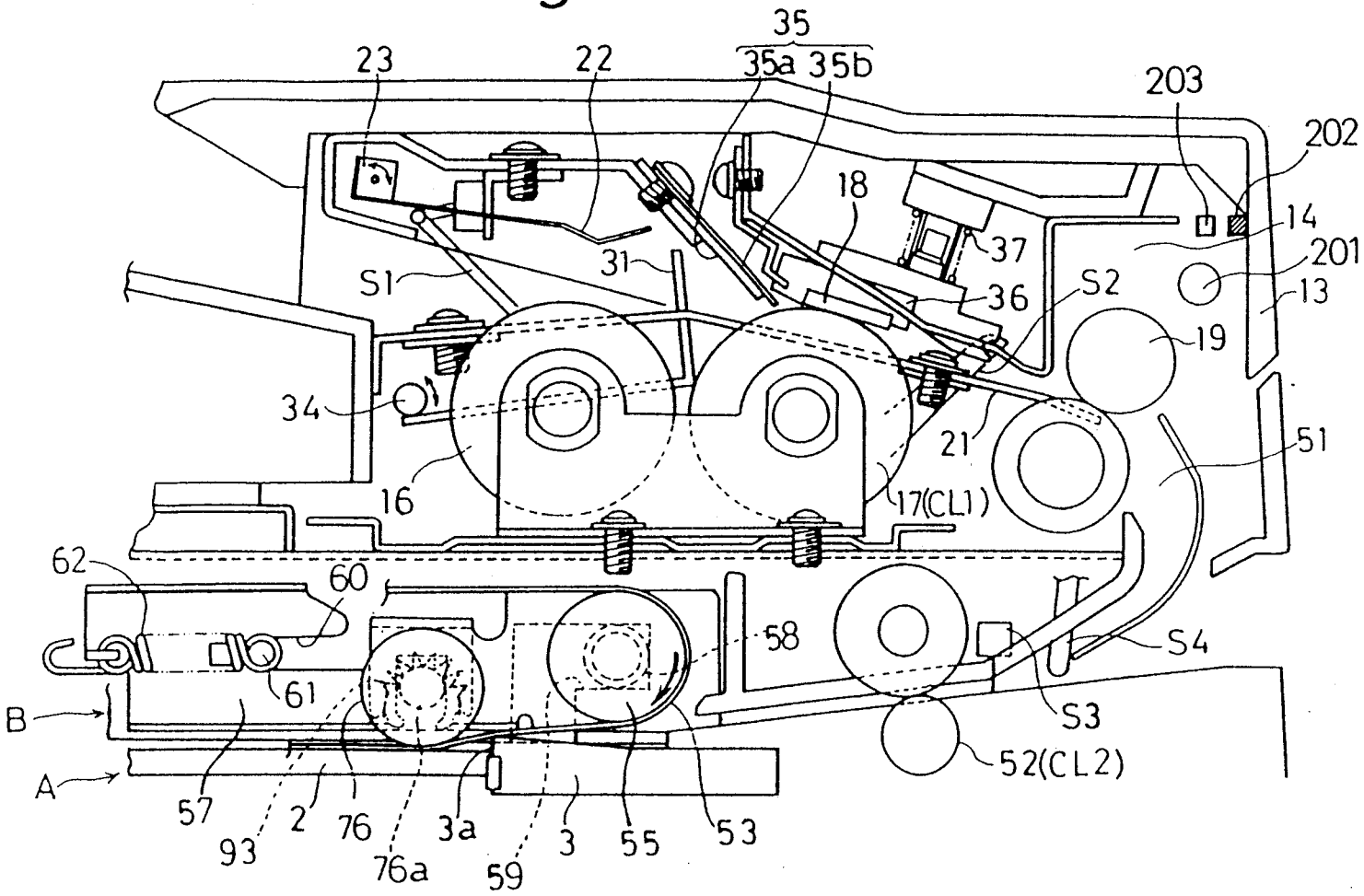
FIG. 4 is an enlarged vertical longitudinal sectional view of a feeding section.

The transport belt 53 is stretched along the original scale 3 and the platen glass 2 by a driving roller 54 and a driven roller 55 supported by frames 65 provided in front and in the rear of main body 13 of the machine. The front end of the driving roller 54 is removably held on a bearing (not illustrated) fixed to the front frame 65 of the main body 13, and the rear end of the roller which is provided with a driven gear 63 to be connected to the main motor M2 is held to the back frame 65 by a bearing 66 fixed to a plate 56 removably fixed by screws 64 (FIGS. 4 and 5). The driving roller 54 thus becomes removable by the removal of the plate 56 and taking in and out of the bearing fixed to the front frame 65, and consequently, the driven gear 63 is geared or ungeared with the driving gear 67 connected with the main motor M2. It may be possible to attach the front end side of the driving roller 54 to the frame 65 through a member similar to the plate 56, however, with the structure as described above, the front end side of the driving roller 54 can be removed from the frame 65 only by taking out of the bearing, and removing work from the driving roller 54 can be carried out easily.

As illustrated in the FIGS. 4 and 6, both ends of the driven roller 55 are supported on a sliding shaft 57 removably and slidably held to the frame 65 in front and in the rear of the main body 13, and the roller is removed by the removal of the sliding plate 57. The sliding plate 57 with the bearing 58 of the driven roller 55 fixed thereto is fitted to a hooked groove 59 formed downward on the frame 65 in front and in the rear, and a hooked groove 60 opened on its upper portion is removably and slidably engaged with a support pin 61 on the front and rear portions of the frame 65. Between the support pin 61 and the sliding plate 57, a spring 62 is actuated to urge the sliding plate 57 in the direction of right hand side of the FIG. 1. The sliding plate 57 then gives tension to the transport belt 53 so as to move the driven roller 55 in the direction of right hand side of the FIG. 1, and at the same time, the state of fitting to the frame 65 is maintained.

The transport belt 53 can thus be removed easily by removing the driving roller 54 and the driven roller 55 downward from the main body 13. Stay 71 for connecting and reinforcing the frame 65 in front and in the rear of the main body 13 is, therefore, provided above the portion where the transport belt 53 is stretched. Inside the transport belt 53, back-up rollers 72, 76 are provided to secure the transporting force by pressing each portion of the transport belt 53 to the platen glass 2. The shafts 72*a* and 76*a* of the back-up rollers 72, 76 are removably held by resin holders 73 attached to the frame 65 and the sliding plate 57 in order not to obstruct the removal of the transport belt 53.

The holder 73 is provided with a pocket portion 73*a*, as illustrated in FIG. 6 and 8, to elastically remove the rotating shaft 72*a*, and the pocket portion 73*a* holds the shaft 72*a* movable upward and downward to cause the back-up roller 72 press the transport belt 53 to the platen glass 2 by its own weight.

Figure 1:
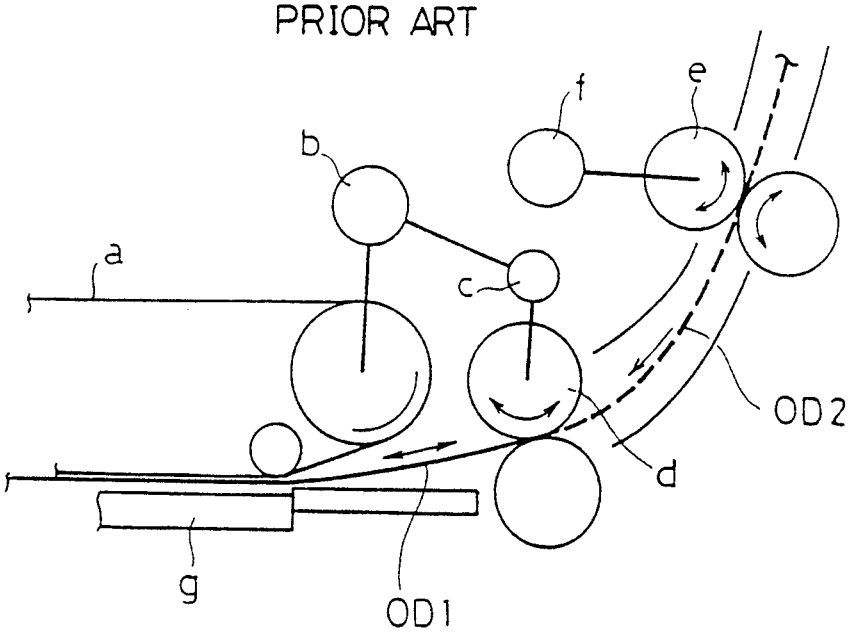
Fig.1 PRIOR ART
FIG. 1 is a schematic side view showing a procedure for aligning two sheets of a first and the next originals under the two-in-one handling mode in a conventional document feeding apparatus.
Figure 2:
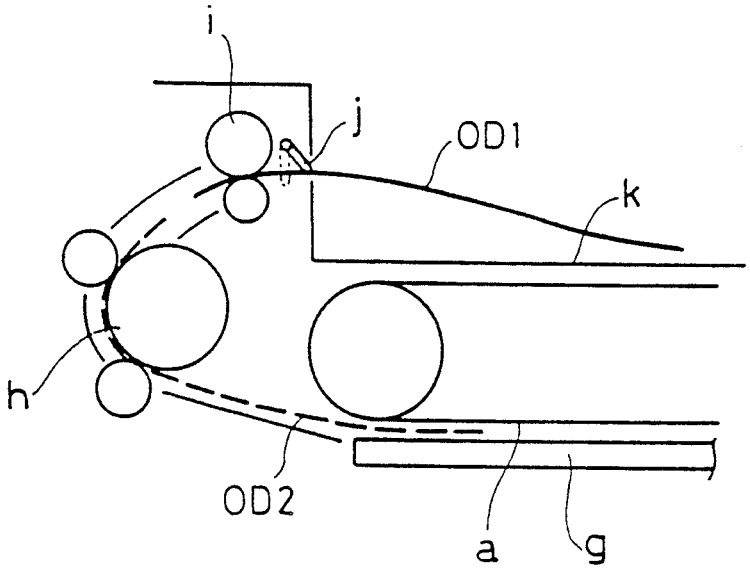
Fig.2 PRIOR ART
FIG. 2 is a schematic side view partially showing how two sheets of the first and the next originals are detected and discharged under the two-in-one handling mode in a conventional document feeding apparatus.

The transport belt 53 forwards an original sent out of the timing roller 52 onto the platen glass 2 when it is driven in the direction of the arrow in cooperative operation of the back-up rollers 72 and 76 and discharges the original on the platen glass 2. When the transport belt 53 is reversely driven, the original fed onto the platen glass 2 comes in contact with the positioning surface 3*a* of the original scale 3 by the switch back operation to position the original on the platen glass 2, or an original inverted and returned from a discharge/return section 81 provided on the left side of the original discharge tray 12 in the FIG. 1 is fed onto the platen glass 2 again for positioning to be ready for reverse side copying operation or the like of both sides original. With adjustment of reverse feeding amount of original, the original is returned to the position of the original scale 3 for positioning without pressing the original under thin paper mode, otherwise the original is pressed to the original scale 3 as a thick original for forcibly positioning the original.

In this embodiment, a first original is fed to the side of the platen glass 2 and after it has passed through the pair of timing rollers 52, it is switched back before it passes the original scale 3 so that the rear edge of the original is adjusted at the nip portion of the timing roller 52, then a second original is fed to the timing roller 52 and the leading edge is adjusted at the nip portion of the timing roller 52. The two originals are now aligned in front and in back of the pair of timing rollers 52, and thereafter, both of the originals are forwarded onto the platen glass 2 as one sheet of original for positioning to be ready for simultaneous copying operation thus enabling an operation of the two-in-one handling mode. After the copying operation is completed, the two originals are handled as one original for discharging or the like.

At a position adjacent the timing roller 52, there is provided a sensor S3 for detecting originals being fed from the feed roller 19. At a predetermined time after it has detected an original, the timing roller 52 is driven again to make timing adjustment between the leading edge adjustment and the copying operation of the copying machine A. At a predetermined time after the sensor S3 has detected the rear edge of the original, that is, at the time when the original passes through the original scale 3 by the distance X0, the drive of the transport belt 53 is stopped and by reversing the drive, the positioning by the switch back operation can be carried out.

The amount of switch back X1 for the positioning is set to become the relation of $X0 < X1$. Accordingly, the original is switched back by X1 more than the distance X0 which has passed through the original scale 3 thereby surely coming in contact with the positioning surface 3*a* for positioning. The transport belt 53 is reversely driven excessively to switch back the original, however, the original which comes in contact with the positioning surface 3*a* is not conveyed reversely further and only slipping occurs between the transport belt 53 because of its strong elasticity.

Conversely, in case of a thin original with weak elasticity, it can not stretch against the positioning surface 3*a* after it has contacted thereto, and consequently, it is bent in a triangle shape gap formed by the platen glass 2, original scale 3 and the transport belt 53, and chopped wrinkles are occurred thereon. In order to avoid such a trouble, the ordinary original positioning mode is switched over to a thin paper mode only when a thin paper mode setting key 75 (FIGS. 3, 9 and 10) is operated to obtain an amount of transport until the rear edge of the original reaches the positioning surface 3*a* by setting a time when the sensor S3 has detected the rear edge of the original so that the original is positioned by stopping the transport belt 53 without resorting to switch back operation.

The path between each back-up rollers 72 and the path between the back-up rollers and the transport means provided in front and in the rear of the back-up rollers are set smaller than a smallest size of original in the direction of transport so that even originals in small size can be surely transported. However, the back-up roller 76 which is arranged beside the driven roller 55 has to be positioned near the driven roller 55 as close as possible. The back-up roller 76 and the driven roller 55 are removably held to the sliding plate 57.

In order to hold the back-up roller 76 and the driven roller 55, a back-up roller holding section 57*a* is incorporatively formed with the sliding plate 57, and the back-up roller 76 is movably held upward and downward by the back-up roller holding section 57*a*. The back-up roller 76 is urged downward by a spring 93 (FIGS. 4 and 6) actuated between the holding section 57*a* to press the transport belt 53 on the edge on the side of the positioning surface 3*a* of the original scale 3, by which originals being switched back are protected from overriding the positioning surface 3*a*.

The length of original in the direction of paper feeding can be judged by the relation between the time required for the sensor S3 to detect the rear edge of an original after it has detected the leading end of the original and the transport speed of the original. In addition, by combining width data of the original detected by a width sensor S4 arranged at an intermediate portion of a U-turn path 51 with the above, the size of the original can be judged, and the judgment can be utilized for selection of cassette and magnification for the copying machine A.

In the return/paper discharge section 81, there is provided a U-turn path 82 extending to the original discharge tray 12 following the platen glass 2, and a reversing roller 83 is arranged in the intermediate portion. At a paper discharge outlet portion 84 facing the original discharge tray 12, a discharge roller 85 is provided. A return path 86 is also arranged for returning an original from an intermediate portion of the U-turn path 82 onto the platen glass 2 along the reversing roller 83.

The reversing roller 83 and the discharge roller 85 are driven by the main motor M2 simultaneously with the transport belt 53. However, in the driving system of the main motor M2, there are provided a first system in which only positive rotation of the main motor M2 is transmitted through a one way clutch and a second system in which only reverse rotation of the main motor M2 is switched over to positive rotation and transmitted through a one way clutch so that the direction of rotation of the main motor M2, that is, to whichever direction the transport belt 53 is driven, the reversing roller 83 and the paper discharge roller 85 are driven only positively. The reversing roller 83 is pressed in contact with reversing rollers 87, 88 to correlatively move an original along the roller 83.

When two sheets of originals which have been completed copying operation under the two-in-one handling mode are discharged, a first original is excessively pushed out by the following original if two sheets are followed by another and they can not be properly adjusted each other on the original discharge tray 12. Therefore, the circumferential speed of the discharge roller 85 is set a little more than the speed of the transport belt 53, and when the first original is transported only by the discharge roller 85, the first original is separated from the following original by the difference in speed as described above. The first original is thus protected from being excessively pushed out by the original followed.

At an inlet of the U-turn path 82, a reversing guide 89 is provided to dip an original discharged from the platen glass 2 by the transport belt 53 onto the U-turn path 82 and the original is guided toward the gap between the reversing roller 83 and the reversing roller 87. The original guided into the U-turn path 82 is then transported by the reversing roller 83 and the reversing rollers 87, 88.

At a portion where a return path 86 is branched off in the U-turn path 82, there is provided a changeover claw 91 and when the changeover claw 91 is positioned on the solid line in the FIG. 3, the original is guided toward the side of the paper discharge outlet 84 to discharge the original onto the original discharge tray 12 by the paper discharge roller 85. When the changeover claw 91 is positioned on the phantom line in the FIG. 3, the original being transported is guided toward the side of the return path 86.

Immediately at the platen 2 side of the reversing rollers 87, there is provided a sensor S5. When the sensor S5 has detected an original, after a certain period of time, that is, before the original has passed through the paper discharge roller 85, the rotating speed of the main motor M2 is lowered at a certain period to press original running out to the original discharge tray 12. By detecting operation of the Sensor S5, reversing timing and the like can be obtained for reversely driving the transport belt 53 in both sides copying operation.

As illustrated in the FIGS. 3 and 9, on the horizontal bottom surface **12*a* of the original discharge tray 12, angle ribs 12*b*, 12*c*, 12*d* for receiving originals are sequentially provided in the original discharging direction. Each of the original receiving ribs 12*b*, 12*c* and 12*d* are positioned corresponding to the size of originals in the direction of transport, and apexes of each rib is positioned at the rear of centroid of originals. The original which is being discharged is thus transported by the transporting force of the paper discharge roller 85 until it reaches one of the original receiving ribs 12*b*–12*d* which correspond to the size of the original in the direction of transport and it is further overridden the apex when it has reached its corresponding rib. However, the pressing resistance at the apex portion restrains the force of original discharge since the original gets out of the paper discharge roller 85 before the center of gravity of the original ride over the point of apex. Accordingly, the rear end of the original is settled close to the rear wall of the original discharge tray 12 which is provided with the paper discharge outlet 84, and any size of original is arranged properly thereat. The original receiving rib 12*d* positioned at the back is lowered because of positional relation between the original set tray 11. On the back of the original set tray 11, a resin film 92 is, therefore, provided to softly press a long original on the original receiving rib 12*d* so that it functions like other original receiving ribs 12*b* and 12*c***.

A cover 13 of the paper feed section 14 is opened and closed centering on a hinge pin 201 as illustrated in the FIG. 4 to facilitate jamming treatment and the like in the paper feed section 14. Inside the cover 13, a magnet 202 is provided to move toward and away from a reed switch 203 fixed in the original transport device B when the cover 13 is opened and closed. The reed switch 203 is thus turned on and off to detect opening and closing of the cover 13. By this detecting operation, when the cover 13 is in a opened state, an original stopper 31 is moved backward or the operation of the original transport device B and the copying machine A is stopped to automatically take safety measure.

A microcomputer 101 shown in the FIG. 10 is utilized for controlling various operations as described above. To the microcomputer 101, the main motor M2 and the paper feed motor M1 are connected through respective driving and speed control circuits 102 and 103.

To the output side of the microcomputer 101, operating members such as original pressing member 22, original stopper 31, each solenoid 24, 32, 104 of changeover claw 91, separation roller 17, each clutch CL1, CL2 of timing roller 52 and a buzzer 105 for making various warnings are connected through a driving circuit 106.

To the input side of the microcomputer 101, original empty sensor S1, paper feed sensor S2, sensor S3 in the timing roller section, width sensor S4, discharge sensor S5, and thin paper mode set key 75, reed switch 203 and the like are connected.

In the microcomputer 101, there are also provided an operation control microcomputer (not shown) arranged on the side of the copying machine A, a serial transmitting line 107 and a serial receiving line 108 for transmitting and receiving signals.

A series of concrete operational control will now be briefly described referring to flow charts shown in the FIGS. 11 through 47.

Prior to explanation of flowcharts, ON-edge is defined as the condition when the switch, sensor or signal changes to ON from OFF state. In addition, OFF-edge is defined as the condition when the switch, sensor or signal changes to OFF from ON state.

FIGS. 11 and 12 are flow charts showing main routines of operational control. When a power source is turned on at step #1, initialization is set. At this initialization process, RAM is cleared and various initial modes are set. Then, at step #2, input processing is performed for checking each one of the sensors S1–S5 and the state of opening and closing of the cover in the automatic document feeding device B and for edge processing. At step #3, output process is performed for various displays and for driving each one of the motors M1, M2, each one of the solenoids 24, 32, 104, each one of the clutches CL1, CL2, the buzzer 105 and the like.

At the following step #4, communication process is performed between the copying machine A. At step #5, input processing especially for the sensors S1–S5, the thin paper mode set key 75 and the like, and internal processing for signals coming in from the copying machine A side are performed with setting and resetting operations of flags accompanied. Then, at step #6, a preparatory paper feed operation process is conducted in case when originals are initially set in the original set tray 11.

At step #7, paper feed operation is conducted for feeding the lowermost original on the original stack tray 11 in accordance with an original feed request until it is adjusted at the position of the pair of timing rollers 52. At the next step #8, an original is discharged onto the platen glass 2 corresponding to a setting of a single side original, and a single side transport operation is conducted for forwarding an original fed onto the platen glass 2. At step #9, a both sides original on the platen glass 2 is inverted and discharged corresponding to a setting of both sides original, and a both sides transport operation is conducted for feeding the both sides original onto the platen glass 2.

At step #10, a transport operation process under the two-in-one handling mode is performed for feeding two sheets of originals onto the platen glass 2 to carry out simultaneous copying operation, and thereafter, they are discharged. At the next step #11, a jam trouble process is performed in case when there occurred a jam trouble in the device B wherein a jam trouble signal is set and displayed in accordance with a judgement made. At step #12, a discharging operation process is performed for discharging originals in the device B corresponding to clear signal, interruption signal, jam signal and the like transmitted from the copying machine side.

At the following step #13, a size detection process for setting size codes of originals is performed corresponding to each mode based on original detection signal of the sensors S3 and S4, and at the final step #14, a routine timer is processed and the program returns to the step #2 upon completion of the timer. Particularly, the width of an original is detected by the sensor S3, and the length of the original is detected basing on the on-time of the sensor S4. More specifically, a size detection counter in the microcomputer is counted upward by a clock while the sensor S4 is being turned on and the length of original is determined basing on the count value at the time when the sensor S4 is turned off. A size code of an original is determined basing on the length and the width of original thus obtained.

A primary subroutine in the main routine will now be described below.

FIGS. 13 and 14 show flow charts of mode processing subroutines. Firstly, on or off signal of a main switch on the copying machine A side is checked and the display on the operation panel of the device B is turned on or turned off (block 21).

The next block 22 is a routine for checking a state of input of the original empty sensor S1. When an original is set in the original set tray 11, an original set flag is set in response to the turning on of the sensor S1, and it is checked whether the original is initially set or not by the presence of on edge of the sensor S1. If it is found that the original is initially set, a first set flag is set for performing a preparatory paper feeding.

When the original on the original stack tray 11 is run out, the original set flag is reset in response to the turning off of the sensor S1, and thereafter, it is checked whether the cover is opened or closed. When the closing state of the cover 13 in the paper feeding section 14 is confirmed by the reed switch 203, the original stopper 31 is raised for stacking next originals. Accordingly, the troubles which may hurt operator's hand or the like can be avoided since the original stopper 31 is raised only when the cover 13 is closed. At the time of jamming trouble, the original stopper 31 is held at the lower position to assure the safety of operators.

At the following block 23, when an original exchange request signal is transmitted from the copying machine A side, it is checked whether it is a jam correction value or not. If the original exchange request signal is an ordinary exchange request signal, a first set flag is reset when it is present. At the same time, a preparatory paper feed request flag is set for performing a preparatory paper feeding corresponding to the original initially set. Then, it is checked whether the original mode is single original mode, or both sides original mode or two-in-one handling mode. Thereafter, a transport operation request flag is set corresponding to the mode judged. In case when there is no first set flag, original mode is checked and a transporting operation request flag is set since the preparatory paper feed operation is not required. When the original exchange request signal is a correction value for jam at this block 23, a discharge request flag is set to get into a subroutine for displaying the number of sheets to be reset by operator corresponding to the correction value.

At the next block 24, when there is a buzzer request signal from the copying machine A side because of no presence of original or the like, the buzzer 10 is operated under a predetermined state and then the program is returned.

FIGS. 15 through 18 show flow charts of subroutines of a preparatory paper feed operation processing. When there is a preparatory paper feed request flag under the mode process described above, the program gets into this routine (block 31), and at the next block 32, it is checked whether the preparatory paper feed operation is started or not, and if the flag is set during the preparatory paper feed operation, the program proceeds to the next block 33 as it is. If the flag is not set during the preparatory paper feed operation, it means that the program has entered into this routine for the first time and a preparatory paper feed operation in process flag is set. Then, by turning on the clutch CL1 with turning on of the paper feed motor M1 at a low speed, the weak paper feed transporting force of the pick-up roller 16 is transmitted to a group of originals set on the original set tray 11 for the first time, whereby a first round of adjustment process is performed in which the lowermost original is brought in contact with the original stopper 31. At the same time, a timer T1 which functions to sufficiently carry out the adjustment operation is set. At this first round of adjustment, it is arranged so as to perform preparatory paper feed for a sufficient period of time by the small transporting force in order to readily adjust originals of thin paper.

At the following block 33, when the timer T1 completed its action, the paper feed motor M1 and the clutch CL1 are turned off to finish the preparatory paper feed operation, and a timer T2 is set. The timer T2 is kept waiting for the next action until the motor M1 and the pick-up roller 16 are completely stopped. Accordingly, at the next block 34, the solenoid 24 of the original pressing member 22 is turned on when the timer T2 finished its action, and a timer T3 is set. The timer T3 sets a time required for the original pressing member 22 to surely press an original on the pick-up roller 16 waiting for the starting time of the solenoid 24.

At block 35, the paper feed motor M1 is turned on at a high velocity after the completion of timer T3, and by turning on the clutch CL1 with turning on of the paper feed motor M1 at a high speed, a second round of preparatory paper feed operation is performed. At this time, the large transporting force is worked on an original since the original is surely pressed on the pick-up roller 16 by the original pressing member 22, and the original comes in contact with the original stopper 31 to be surely adjusted and positioned thereat. The time for the second round of adjustment operation is regulated by the timer T4 to become as $T1 > T4$. In other words, as the first round of adjustment operation is performed primarily for the adjustment of the originals of thin paper, the pick-up rollers 16 is singly operated for a longer period by the timer T1. While the second round of adjustment operation is aimed at adjusting the originals of thick papers, the second round of adjustment operation is performed by the pick-up roller 16 in cooperation with the original pressing member 22 for a shorter time period of timer T4 than the timer T1. Accordingly, the adjustment of the originals of thick paper is surely accomplished. In case of the originals of thin paper, the originals are adjusted and made in a bunch when the first round of adjustment operation is finished, and therefore, the leading edge keeps the adjusted state even if it receives a stronger transporting force at the second round of adjustment operation.

At block 36, when the timer T4 is finished its action, the paper feed motor M1 and the clutch CL1 are turned off to complete the second round of preparatory paper feed operation, and a timer T5 is set. When the thin paper mode is set, the process at the blocks 35 and 36 for processing the originals of thick paper is not performed and the program jumps to block 37.

The timer T5 is arranged for waiting a period of time until the pick-up roller 16 stops completely. If the original stopper 31 is moved downward in order to feed an original while the pick-up roller 16 is being rotated, the leading edge of the original is hitched on the original stopper 31 which is moving downward by the transporting force of the original and as a result, the leading edge is bent and causes the original to skew, jam or the like. Such troubles can thus be avoided by preparing the waiting time as described above.

At block 37, therefore, since the timer T5 stops its action, the original stopper 31 is moved downward by the turning on of the solenoid 32, and the clutch CL1 is turned on to set a timer T6. The timer T6 is provided for checking the time until the original stopper 31 is sufficiently moved downward by the turning on of the solenoid 32, and by turning on the solenoid 32 before the clutch CL1 is turned on, the delay in starting time of the solenoid 32 is somewhat absorbed.

At block 38, when the timer T6 stops its action, a preparatory paper feed flag and a preparatory paper feed operation in process flag are reset, and at the same time, a paper feed operation in process flag and a paper feed request flag are set to immediately get into subroutines of paper feed operation processing shown in FIGS. 19 and 20, and a preparatory paper feed operation subroutine at block 41 duplicated with the present subroutine is jumped, and a timer T11 for entering into a paper feed routine which does not duplicate is set and the program is returned.

The paper feed operation process subroutines in FIGS. 19 and 20 are executed since there is a paper feed request flag at block 41, and only when there is no flag of paper feed operation in process, the original pressing member 22 is moved downward by turning on the solenoid 24, and at the same time, the clutch CL1 is turned on to prepare for the next paper feed operation, and thereafter, timer T11 is set. However, if there is a flag of paper feed operation in process, the program proceeds to block 42 as it is since the paper feed operation is prepared by the second round of preparatory paper feed operation. The timer T11 is provided for checking the time required for the original pressing member 22 to surely press an original on the pick-up roller 16 by action of the solenoid 24.

At block 42, with the timer T11 finished its action, the paper feed motor M1 is turned on at a low speed to start paper feed operation, and at the following block 43, an original pressing member releasing timer T12 is set when the paper feed sensor S2 has detected the leading edge of an original. The timer T12 is provided for checking the time an original to be fed is surely inserted between the pair of feed rollers 19 from the time the original is positioned at the sensor S2, and when the timer T12 is finished its action, the original pressing member 22 is moved upward by turning off the solenoid 24 (block 44), by which the original pressing member 22 can be arranged not to give any bad effect on the paper feeding operation thereafter.

At the next block 45, a timing timer T13 is set after a sensor S3 in the timing roller section has detected the leading edge of original. The timer T13 is provided for checking the time required for an original to reach the pair of timing rollers 52 being stopped and the leading edge is pushed to the nip portion of the timing roller 52 for adjustment thereat, and at the following block 46, with the timer T13 completed its action, the paper feed motor M1 and the clutch CL1 are turned off, and setting of a precedent feed completion flag and resetting of a paper feed operation in process flag and a paper feed request flag are performed. Thereafter, the program is returned.

The original transported to the pair of timing rollers 52 in such a manner as described above is thereafter handled in different modes corresponding to original mode in the processing subroutine, that is, a single side mode, both sides mode or two-in-one handling mode, depending on the kind of flag set for transport operation request. More specifically, when a single side transport operation request flag is set, the single side transport operation subroutine in the main routine is executed, or when a both sides transport operation request flag is set, the both sides transport operation subroutine is executed, or when a transport operation request flag for two-in-one handling mode is set, the transport operation subroutine for the two-in-one handling mode is executed.

FIGS. 21 through 28 show the single side transport operation subroutines. When there is a single side transport operation request flag, the program enters into this routine (block 51). Then, at block 52, it is checked whether or not there is an original existence flag which indicates the presence of original on the platen glass 2, and if there is a flag, the program proceeds to block 53, however, if there is not, the program jumps to block 58.

At block 53, it is checked whether or not there is a flag of single side operation in process. Only when there is no such a flag, the main motor M2 is turned on for positive rotation at high velocity judging that the program has entered into this routine for the first time, and a timing timer T21 for starting rotation at low speed and a flag of single side operation in process are set.

Then at block 54, the main motor M2 is changed over to a low speed operation since the timer T21 finished its action. This changeover is performed immediately before an original being transported at high speed is discharged so that the force to discharge the original is restrained and the original is aligned properly on the original discharge tray 12.

At the following block 55, a discharge sensor S5 detects the rear edge of an original and a discharge timer T22 is set. The timer T22 is provided for checking the time required for the original to be surely discharged after it has reached the sensor S5, and at block 56, with completion of the timer T22, a discharge completion flag is set and a flag of existence of original on the glass is reset to move to the processing at and after block 57 of original transporting operation.

At block 57, precedent feed completion flag is checked, and if there is not this flag, it is judged that an original discharged previously is the last original, and the program moves to block 58. On confirming that there is a flag of single side operation in process, reset of the flag of single side operation in process, turning off of the main motor M2, reset of single side operation request flag and discharge completion flag are performed, and the program is returned with completion of the single side transporting operation.

When there is a precedent feed completion signal at block 57, the program enters into the processing at and after block 59 for original transporting operation, and at first it is checked whether or not there is a flag of single side operation in process. If there is not this flag, the program enters into the original transporting operation for the first time. In other words, transportation of a first original is started. The main motor M2 is then turned on at a low speed positive rotation, and an on timer T23 of the clutch CL2 of the pair of timing roller 52 and a single side operation in process flag are set. The timer T23 first makes the transport belt 53 at a state of low speed driving, that is, the same state as that of an ordinary original exchange process, and after a predetermined period of time, the pair of timing rollers 52 is turned on, and at the same time, the main motor M2 is changed over to a high speed to immediately forward an original to be ready for transportation. Accordingly, occurrence of error in detecting the size of original which arises from delayed start of the main motor M2 at the time when the pair of timing rollers 52 is started for original feeding can be avoided.

At the next block 60, upon completion of the timer T23, a discharge completion flag is set to enter into processing of original exchange operation at and after block 61. At block 61, confirming that the discharge completion flag is set, the clutch CL2 of the pair of timing roller 52 is turned on, and at the same time, the main motor M2 is changed over to high speed. Accordingly, an original is transported onto the platen glass 2 by the high speed operation of the pair of timing rollers 52 and the transport belt 53. At the same time, motor pulse is read for detecting the size of the original, and an on timer T24 of the paper feed motor M1 is set, and then, the discharge completion flag is reset.

The timer T24, by delaying the drive of the paper feed motor M1 for a predetermined period of time, the peak value of electric current when the transport belt 53 which possess large torque is driven at high speed by changing over the main motor M2 to a high speed drive and the peak value of electric current for starting the paper feed motor M1 do not coincide with each other, and it further avoids the starting lag of two motors M1 and M2. The motor M1 is, therefore, turned on at high speed upon completion of the timer T24 at block 62.

At the next block 63, the counter for detecting the size of original stops its reading operation when the sensor S3 at the timing roller section has detected the rear edge of original, and a size detection request flag for executing a size detecting subroutine is set. At the same time, an original set signal is transmitted to the copying machine A as a copy start signal, and the paper feed motor M1 is turned off. At this time, original is not set at a predetermined position on the platen glass 2, however, the copy start signal is transmitted a little earlier since it takes a time for starting copying operation, in other words, for the start of scanning operation so that the operation can be carried out efficiently.

When the thin paper mode set key 75 is turned on, a stop timer TS1 is set, and if it is not turned on, a stop timer TS2 is set. The timer TS1 is provided for checking the time required for an original to reach the positioning surface 3*a* of the original scale 3 after the rear edge of the original has reached the sensor S3 in the timing roller section, and it regulates the time to stop the original at the position of the original scale 3 on the platen glass 2 by only setting the amount of original transportation corresponding to the state that the thin paper mode is set. Consequently, the original of thin paper is protected from being bent or wrinkled by hitting the original scale 3 when it is positioned.

The timer TS2 is provided for checking the time required for an original to pass through the original scale 3 exceeding a predetermined amount XO after the rear edge of the original has reached the sensor S3 at the timing roller section, and it regulates a time for preliminary forwarding the original so as to pass through the original scale 3 exceeding the predetermined amount XO in order to properly position an original by switching back the original of thick paper corresponding to the state that the thin paper mode is not set.

Then, at block 64, upon completion of the timer TS1, the main motor M2 and the clutch CL2 are turned off assuming that the original of thin paper has been forwarded and positioned on the platen glass 2, and transporting operation of the original is stopped. At this time, the single side operation request flag is reset and the flag of existence of original on the glass is set, and the single side operation in process flag and the precedent feed completion flag are reset. Further, when the original empty sensor S1 is turned on, paper feed request flag is set to prepare for the next paper feed operation since there is an original in the original stack tray 11.

At block 65, upon completion of the timer TS2, the main motor M2 and the clutch CL2 are turned off assuming that an original of thick paper has been transported onto the platen glass 2 passing through the original scale 3 exceeding a predetermined amount XO, and at the same time, a delay timer T25 is set for reversing operation.

Then, at the next block 66, by completion of the timer T25, the main motor M2 is turned on at a low speed rotation to reversely drive the transport belt 53 at low speed, and a reversing stop timer T26 is also set. The timer T26 is provided for setting a time required for obtaining a switchback amount XI to switch back the original of thick paper which has been transported to the original scale 3 on the platen glass 2 exceeding the amount XO to surely come in contact with the positioning surface 3*a* of the original scale 3 by the transport belt 53 being driven reversely, and at the next block 67, upon completion of the timer T26, the original is switched back and the main motor M2 is turned off assuming that the original has been positioned coming in contact with the positioning surface 3*a* of the original scale 3. The single side operation request flag is reset and the flag of the existence of original on the glass is set, and further, the reset of single side operation in process flag and precedent feed completion flag are performed. When the original empty sensor S1 is turned on, it means that there is an original on the original set tray 11, and the paper feed request flag is set, then the program is returned in the same manner as that of the routine 64.

FIGS. 29 through 38 show subroutines of both sides transport operation processing.

At block 71, the program enters into the routine when there is a both sides operation request flag. It is checked whether or not there is a flag of original existence on the glass (block 72), and if there is, it is further checked whether or not the original on the platen glass 2 is facing the second surface by the existence or non-existence of a second surface flag (block 73). If it is the second surface, the program proceeds to a discharge operation processing routine at blocks 74 through 77. If, however, it is not the second surface, the program jumps to reverse operation processing routine at blocks 78 through 83 since it is subjected to reverse operation.

In case of the discharge operation processing routine, it is checked whether or not there is a both sides operation in process flag at block 74. Only when there is no flag, the main motor M2 is positively turned on at high speed judging that the program has entered into this routine for the first time, and a timer T31 for starting low speed driving and a both sides operation in process flag are set. Then, at block 75, upon completion of the timer T31, the main motor M2 is changed over to low speed driving operation. The timer T31 is utilized for the same purpose as that of the timer T21.

At the following block 76, a discharge timer T32 is set with detection of the rear edge of an original by the discharge sensor S5. The timer T32 is also utilized for the same purpose as that of the timer T22. At block 77, upon completion of the timer T32, reset of original on the glass flag, discharge completion flag and second surface flag are performed and the program is returned.

In the reverse operation processing routine, it is first checked whether or not there is a both sides operation in process flag at block 78, and if there is not, the main motor M2 is positively turned on at high speed and the transport belt 53 is positively driven at high speed since the program has enter into this routine for the first time. The changeover claw 91 is also changed over to the original reversing position by turning on the solenoid 104 and the both sides operation in process flag is set. The original whose first surface has been copied and placed on the platen glass 2 is then transported and discharged to the U-turn path 82 in the paper discharge section 81 by the transport belt 53, and it is guided by the changeover claw 91 to the return path 86 branched off from the U-turn path 82 and is inverted thereat.

At the next block 79, a main motor positive rotation stop timer T33 is set upon detecting the leading edge of an original by the discharge sensor S5, and if the thin paper mode is set, a timer TS11 for originals of thin paper is set, while if the thin paper mode is not set, a timer TS12 for originals of thick paper is set.

A timer T33 is provided for setting a time an original requires until its leading edge is pushed into a gap between the platen glass 2 and the transport belt 53 through the return path 81, and obtains a timing to temporarily stop the original being returned in inverted state in order to reversely drive the transport belt 53 for transporting the original again onto the platen glass 2. The timer TS11 sets a time required to transport an original being returned to the position exactly at the positioning surface 3*a* of the original scale 3 when the thin paper mode is set so that an original of thin paper can be positioned without any inconvenience. When the thin paper mode is not set, the timer TS12 sets a time which requires to transport an original being returned to surely press it against the positioning surface 3*a* of the original scale 3 and forcibly position the original thereat wherein the original is sent excessively by the amount (X1-XO) by making use of the nature of original of thick paper.

At the next block 80, upon completion of the timer T33, the main motor M2 is turned off, and a reverse rotation starting timer T34 of the main motor M2 is set. The timer T34 is provided for setting a time required to completely stop the main motor M2, the transport belt 53 and the like. At block 81, upon completion of the timer T34, the main motor M2 is reversely turned on at high speed to reversely return the original onto the platen glass 2 by the transport belt 53. An off timer T35 of the solenoid 104 at the changeover claw 91 is also set accordingly.

At the following block 82, upon completion of the timer T35, the solenoid 104 is turned off to return the changeover claw 91 to the original discharge position.

At the next block 83, upon completion of the timer TS11 or TS12, the main motor M2 is stopped assuming that a returning original is positioned on the platen glass 2. Then, the both sides operation in process flag is reset and the second surface flag is set, and at the same time, the both sides transport operation request flag is reset. It is also checked hereat whether or not the discharge sensor S5 is turned on, and if it is turned on, it means that an original is jammed, and therefore, a jam processing request flag is set. If it is not turned on, an original set signal is transmitted to the copying machine A side to be ready for the second surface copying operation.

At block 84, precedent feed completion flag is checked, and if there is not this flag, the program proceeds to block 85 and upon confirming that there is a both sides operation in process flag, the both sides operation in process flag is reset and the main motor M2 is turned off. The both sides transport operation request flag and the discharge completion flag are also reset and the program is returned upon completing the both sides transport operation. If there is precedent feed completion flag at block 84, the program enters into an original transport operation at and after block 86, and it is first checked whether or not there is a both sides operation in process flag. If there is not this flag, the main motor M2 is positively turned on at low speed in order to start a transport operation of a first original, and an on timer T36 of the clutch CL3 of the pair of timing rollers 52 and the both sides operation in process flag are set. The timer T36 is utilized for the same purpose as that of the timer T23.

At the next block 87, upon completion of the timer T36, a discharge completion flag is set and the program enters into original exchange operation routines at blocks 88 through 96.

At block 88, upon confirming that a discharge completion flag is set, the clutch CL3 of the pair of timing rollers 52 is turned on and the main motor M2 is changed over to a high speed operation to transport an original onto the platen glass 2 at high speed. At the same time, it is started to read motor pulse in order to detect the size of original and on timer T37 of the paper feed motor M1 is set, and a discharge completion flag is reset. The timer T37 is utilized for the same purpose as that of the timer T24.

At the next block 89, upon completion of the timer T37, the paper feed motor M1 is turned on at high speed, and at block 90, by the detection of the rear edge of an original with the sensor S3 positioned in front of the timing roller, the counter for detecting the size of original is stopped reading and a size detection request flag is set. The paper feed motor M1 is also turned off and the changeover claw 91 is changed over to the return side by the turning on of the solenoid 104.

At the following block 91, by detection of the leading edge of an original with the discharge sensor S5, the clutch CL2 of the timing roller 52 is turned off and a positive rotation stop timer 38 of the main motor M2 is set. The positioning timer TS11 or TS12 is set depending on whether the thin paper mode is set or not.

And, at block 92, upon completion of the timer 38, the main motor M2 is turned off and a reverse rotation starting timer T39 is set. The timer T38 is utilized for the same purpose as that of the timer T33, and the timer T39 is utilized for the same purpose as that of the timer T34 respectively.

Further, at block 93, upon completion of the timer T39, the main motor M2 is turned on at a high reverse rotation and an off timer T40 of the changeover claw 91 is set. Then, at block 94, upon completion of the timer T40, a solenoid 104 is turned off to return the changeover claw 91 to the paper discharge position.

At the next block 95, upon completion of positioning of an original by the timer TS11 or TS12, the main motor M2 is turned off and both sides operation request flag is reset, while an original existence on the glass flag is set. A both sides operation in process flag and a precedent feed completion flag are also set.

At block 96, when the discharge sensor S5 is still turned on, a jam processing request flag is set judging that the jam is occurred, and if it is not turned on, an original set signal is transmitted to the copying machine A to be ready for copying operation. At the same time, if it is judged by the original empty sensor S1 that original is emptied, the program is returned as it is. However, if original is not emptied, a paper feed request flag is set to be ready for the next paper feeding and the program is returned.

FIGS. 39 through 47 show flow charts of a transport operation processing subroutines under the two-in-one handling mode, and the program enters into this routine if there is a transport operation request flag under the two-in-one handling mode (block 101). At block 102, if there is an original existence on the glass flag, discharge operation at blocks 103 through 105 are conducted. If there is not the original existence on the glass flag, the program jumps to and after block 106 to perform exchange operation.

In case of the discharge operation, it is checked whether or not there is the two-in-one handling mode operation in process flag. Only when there is not the flag, the main motor M2 is turned on at a low speed positive rotation judging that the program has entered this routine for the first time, and a rear end of original detection starting timer T41 and a two-in-one handling mode transport operation in process flag are set. The timer T41 is provided for determining a timing to permit the discharge sensor S5 to perform detecting operation when two sheets of originals set on the platen glass 2 are discharged. In a two-in-one mode, it is necessary that two sheets of originals on the platen glass 2 have to be discharged as if they are one sheet of original. Accordingly, it is necessary for the discharge sensor S5 to detect the rear end of the second original, not the rear end of the first original, in order to confirm the completion of discharge operation. When two sheets of originals on the platen glass 2 are subsequently discharged, there may occur a gap between two sheets of the originals, though it is slight. When such a gap has occurred, the discharge sensor S5 may erroneously judge that the discharge of the two sheets of the originals has been completed when it detects the rear end of the first original.

In order to prevent such an erroneous judgment, the timer T41 is provided for regulating detecting timing of the sensor S5. More particularly, at the timing when the rear edge of the first original passes through the discharge sensor S5, detecting action of the discharge sensor S5 is prohibited, and at the timing when the rear edge of the second original passes through the discharge sensor S5, the detecting action of the discharge sensor S5 is permitted. In a manner as described above, two sheets of the originals are handled as if they are one sheet of original, and the relations between the discharge action of two sheets of originals and the other actions are surely and properly controlled.

At block 104, when the discharge sensor S5 has detected the rear edge of original and the timer T41 has completed its action, in other words, in case the rear edge of the original has been detected when the detecting action of the sensor S5 is permitted, a timer T42 is set for the time required to surely discharge the second original.

At the next block 105, upon completion of the timer T42 which is assumed as discharge completion of the second original, an original exist on the glass flag is reset and a discharge completion flag is set.

In case of an exchange operation, if there is a precedent feed completion flag at block 106 after the discharge operation, the program enters into an original exchange operation at and after block 108 since the original discharged is not the final original, and if there is not the flag, the program proceeds to block 107 since it may be the last original or the second original is being waited for.

At block 107, feeding of a second original is started and upon confirming that there is a second flag until it reaches the timing roller 52, the program is returned. When there is not the second flag, two-in-one flag is checked. If there is the two-in-one flag, the two-in-one operation in process flag is reset corresponding to the final original, and the main motor M2 is turned off. A two-in-one transport operation request flag and a discharge completion flag are also reset to finish the two-in-one transport operation and the program is returned.

At block 108 wherein the program enters into an original exchange operation, two-in-one operation in process flag is checked at a first original transport operation, and if there is not this flag, the main motor M2 is turned on at a low speed positive rotation and an on timer T43 of the clutch CL2 at the pair of timing rollers 52 section is set, while the two-in-one operation in process flag is set.

At the next block 109, upon completion of the timer T43, a discharge completion flag is set, and by confirming this flag at the following block 110, the transport of originals whose leading edges are adjusted at the pair of timing rollers 52 is started by turning on the clutch CL2 of the pair of timing rollers 52, and reading operation of an original size detecting counter is also started. On timer T44 of the paper feed motor M1 is set and resetting of the discharge completion flag is also performed.

Then, at the next block 111, upon completion of the timer T44, the paper feed motor M1 is turned on at low speed and paper feed operation is performed. And, at block 112, when the sensor S3 at the timing roller section has detected the rear edge of an original and if there is not a flag of first original at the timing roller section, a size detection request flag is set since it is the rear edge of the first original, and at the same time, reading operation of the size detection counter is stopped so as to perform size detection. A rear edge passed through timing roller section flag and a first original at the timing roller section flag are set, and at the same time, the paper feed motor M1 is turned off and the program is returned. This returning action is performed in order to enter into a size detection subroutine corresponding to the setting of a size request flag. If there is the first original flag, it means that the second original has passed through the timing roller section, and the paper feed motor M1 is stopped since feeding of the second original is finished. The first original at the timing roller section flag is reset, and an original stop timer TS22 is set to return the program.

Further, at block 112, when the rear edge of original is not checked by the sensor S3 at the timing roller section, the program jumps to block 113. At this block 113, a rear edge passed through timing roller section flag is checked, and if there is the flag, it means that the rear edge of the first original has passed through the timing roller section, and therefore, it is checked whether two-in-one transport operation is feasible or not. Firstly, original emptiness is checked by a state whether the original empty sensor S1 is turned on or not, and if it is emptied, it means that the first original was the last original in odd number and the same transport processing is conducted as that of the single side transport operation. However, if it is not the size which is applicable to a copying operation under the two-in-one transport operation, it has to be coped with other processing. More particularly, it is checked whether or not the size is applicable to copying operation under the two-in-one transport operation (for instance, whether it is JIS standard A4 size, B5 size in cross-feed or A5 size in cross-feed and longitudinal feed), and a half part erase request flag is set for erasing a latent image on a photoconductive drum corresponding to a space on which a second sheet of applicable size is placed.

If only a sheet of original is set for copying at a space wherein two sheets of originals are placed, a portion of the transport belt 53 where there is no original is copied and liable to copy stains of the belt. If the size is more than the size applicable to the two-in-one operation and it is processed under the two-in-one transport operation, originals are lain on top the other at a portion and there occurs a portion where copying is not done. In case of the originals of such a size, a half part erase request flag is not set since an image is chipped off when the half part erasing is conducted.

After the half part erase request flag is set or some actions are taken to skip the processing, a passed through timing roller flag and a first original in timing roller flag are reset, and an original stop timer TS21 is set so as to be able to position the first original at the position of the original scale 3. Accordingly, the half part erasing operation is performed on an original placing space far side from the original scale 3.

At block 113, when original is not emptied, it is checked whether the size is applicable to the two-in-one operation, and if it is the size applicable, a main motor stop timer T45 is set to stop an original passed through the section of the pair of timing roller at a position within the original scale 3 in order to adjust the rear edge by reversely transporting the original after the first original has passed through the timing roller section 52, however, if it is not the size applicable to the two-in-one operation, a timer TS21 is set for positioning the original at the position of the original scale 3 by resetting the first original in timing roller section flag in order to change over to the single side transport operation processing. In either case, a rear edge passed through timing roller section flag is reset.

Then, at block 114, upon completion of the timer T45, the main motor M2 and the clutch CL2 of the pair of timing rollers 52 are turned off, and reverse transporting operation is started to adjust the rear edge of the first original by the pair of timing roller 52. A reverse rotation starting timer T46 is set, and a paper feed request flag and a second original flag are set to feed the second original.

At block 115, upon completion of the timer T46, the main motor M2 is turned on at a low speed reverse rotation and a reverse rotation stop timer T47 is set for setting a time in which the first original transported onto the platen glass 2 is switched back and the rear edge of the original comes in contact with the nip section of the pair of timing rollers 52. At the following block 116, upon completion of the timer T47, the main motor M2 is turned off and a precedent feed completion flag is reset, by which the rear edge adjustment of the first original by the pair of timing rollers 52 is completed.

Block 117 is executed upon completion of the timer TS21 which is set when the size is not applicable to the two-in-one operation or when the original is the last and in odd number. Upon completion of the timer TS21, an original set signal is transmitted to the copying machine A to be ready for copying operation. The main motor M2 and timing roller clutch CL2 are then turned off and the positioning of original against the original scale 3 by reverse transporting operation is completed. Only when original is not emptied, a paper feed request flag is set for the next paper feeding, and thereafter, an original exist on the glass flag is set, and each of two-in-one operation in process flag, precedent feed completion flag and two-in-one transport operation request flag is reset and the program is returned.

At block 118, it is checked whether there is a second original flag or not, and if there is the flag, the timing roller clutch CL2 is turned on to transport both of the first original and the second original adjusted in front and in the rear of the nip section of the timing roller onto the platen glass 2, then a second original flag is reset and on timer T48 of the main motor M2 is set.

And, at block 119, upon completion of the timer T48, the main motor M2 is turned on at a low speed positive rotation to feed the second original onto the platen glass 2, and on timer T49 of the paper feed motor M1 is set. At block 120, upon completion of the timer T49, the paper feed motor M1 is turned on to correspond with the transporting operation of the second original onto the platen glass 2.

Blocks 118 through 120 are executed when the second original is processed. In these blocks, the clutch CL2 of the pair of timing rollers 52, main motor M2 and paper feed motor M1 are sequentially turned on in this order to eliminate a gap which may occur between the first original and the second original. Since it takes time until actual driving is started after the clutch CL2 is turned on, if the main motor M2 is turned on ahead of the clutch, transport of the first original is preceded and the second original is delayed thus causing to occur a gap between two of the originals. In this apparatus, the main motor M2 is turned on after the clutch CL2 is switched on so that the transport belt 53 and the timing roller 52 are driven simultaneously, thereby realizing simultaneous transportation of the first and second originals onto the platen glass 2. Thus, occurrence of gap between the originals can be eliminated.

Because the load for the main motor M2 is larger than that for the paper feed motor M1, the main motor M2 is controlled to turn on ahead of the paper feed motor M1. By this control, the timing for starting the transport belt 53, the pair of timing rollers 52 and the paper feed roller coincides with each other with absorbing delayed starting of the main motor M2 because of its larger torque so that overlapping of two sheets of originals can be avoided. In case when there occurs a gap inevitably between the first original and the second original, it may be arranged to eliminate the gap by starting the transport of the second original by the feed roller 19 a little earlier than the first original.

Finally, at block 121, the same operational processing as that of the block 117 is performed wherein the next paper feed operation is arranged to be made when original is not emptied and when the copying operation can be performed under the state that two sheets of originals forwarded onto the platen glass 2 are positioned at the position of the original scale 3.

In this embodiment, the thin paper mode set is manually performed by use of the thin paper mode setting key 75, however, it may be arranged to automatically set. For instance, the thin paper mode can be automatically judged if it is arranged to automatically judge the thinness of original by detecting the difference in transmittance according to the thickness of originals with a transmittance photosensor or reflective photosensor, or by detecting the difference in vibration according to the thickness of originals by use of ultrasonic wave sensor, or by detecting the difference in amount of movement of the transport rollers and guide rollers when original is passed through.

In this embodiment, it is arranged to provide the transport belt 53 with tensile force by energizing the driven roller 55 with the spring 62, however, any kind of transport belt made of elastic material may be utilized. If the driven roller 55 is arranged to be attached to the frame 65 in the same manner as that of the driving roller 54, the driven roller 55 may be more easily attached and removed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a document feeding apparatus which is capable of operating in a first mode in which a sheet of original is set on an exposure platen and in a second mode in which two sheets of originals are set side by side on the exposure platen, said apparatus comprising:

an original table for placing a plurality of originals;

a first transport means for feeding originals placed on the original table one by one therefrom in the first mode, and for sequentially feeding two sheets of originals placed on the original table therefrom in the second mode;

a second transport means for setting the original fed by the first transport means on the platen and discharging the original from the platen after an exposure process in the first mode, and for setting the two originals fed by the first transport means side by side on the platen along the feeding direction of the original and discharging the originals sequentially from the platen in the second mode;

a detecting means for detecting the rear edge of the originals being discharged from the platen;

a control means for controlling the operation of the first transport means in response to the detecting means; and a prohibiting means for prohibiting the detecting means from detecting the rear edge of a first original being discharged ahead of the other in the second mode.

2. A document feeding apparatus capable of placing and setting two sheets of originals on an exposure platen, comprising:

an original table for placing a plurality of originals;

a first transport means for sequentially feeding two sheets of originals placed on the original table;

a second transport means for setting side by side two sheets of the originals fed by the first transport means on the platen and discharging the originals sequentially from the platen after an exposure process;

a detecting means for detecting the rear edge of an original discharged from the platen;

a control means for controlling the operation of the first transport means in response to the detecting means; and a prohibiting means for prohibiting the detecting means from detecting the rear edge of a first original being discharged ahead of the other.

3. In a document feeding apparatus having a transport means which is reversibly rotatable and is provided opposite to an exposure platen for setting originals on the platen, a paper feed means for feeding originals to the transport means, a pair of rollers provided between the paper feed means and the transport means, a first driving means for driving the paper feed means, a second driving means for driving the transport means and a clutch means for selectively transmitting the driving force of the second driving means to the pair of rollers, said apparatus capable of performing operations wherein the rear edge of the first original is brought in contact with one side of the pair of rollers and the leading edge of the second original is brought in contact with the other side of the pair of rollers, and thereafter, the first original and second original are sequentially fed to the platen by driving the first driving means, the second driving means and the clutch means so as to set side by side the two originals on the platen, said apparatus comprising:

control means for causing the rear edge of the first original to come in contact with one side of the pair of rollers and causing the leading edge of the second original to come in contact with the other side of the pair of rollers, and then, operating the second driving means after the clutch means is actuated, and thereafter, further operating the first driving means.

4. In a document feeding apparatus wherein a first and a second original placed on an original table are sequentially fed by a first transport means and the originals fed by the first transport means are set side by side on a platen along the feeding direction of the originals by a second transport means, and then, the originals are sequentially discharged from the platen after an exposure process is performed, a method comprising the steps of:

providing a detecting means for detecting the rear edge of originals being discharged from the platen;

actuating the second transport means for discharging the originals which have completed the exposure process;

actuating the first transport means in response to the detecting means; and prohibiting the detecting means from detecting the rear edge of the first original discharged from the platen.

5. In a document feeding apparatus having a transport means which is provided opposite a platen for setting originals on the platen, a paper feed means for feeding originals to the transport means, a pair of rollers provided between the paper feed means and the transport means, a first driving means for driving the paper feed means, a second driving means for driving the transport means in a first or a second direction, and a clutch means for selectively transmitting a driving force of the second driving means to the pair of rollers, said apparatus capable of setting side by side two sheets of originals on the platen, a method comprising the steps of:

(1) setting a rear edge of a first original in contact with one side of the pair of rollers and the leading edge of a second original in contact with the other side of the rollers;

(2) energizing the clutch means;

(3) energizing the second driving means after a first predetermined time from the time the clutch means is energized; and (4) energizing the first driving means after a second predetermined time from the time the second driving means is energized; whereby the first and the second originals simultaneously start moving to the platen.

6. The method as defined in claim 5, the step (1) includes the following steps of:

energizing once the first driving means to forward the first original;

energizing the second driving means forward and the clutch means to transport the first original toward the platen;

energizing the second driving means backward and deenergizing the pair of rollers to transport the first original reversely to the pair of rollers after the rear edge of the first original has passed through the pair of rollers;

deenergizing the second driving means after the rear edge of the first original has come in contact with the pair of rollers;

energizing the first driving means again to forward the second original; and deenergizing the first driving means after the leading edge of the second original has come in contact with the pair of rollers.

7. In a document feeding apparatus having a transport means which is reversibly rotatable and is provided opposite to an exposure platen for setting originals on the platen, a paper feed means for feeding originals to the transport means, a registration means including a pair of rollers provided between the paper feed means and the transport means, a first driving means for driving the paper feed means, and a second driving means for driving the transport means, said apparatus capable of performing operations wherein the rear edge of the first original is brought in contact with one side of the registration means and the leading edge of the second original is brought in contact with the other side of the registration means, and thereafter, the first original and second original are sequentially fed to the platen by driving the first driving means and the second driving means so as to set side by side the two originals on the platen, said apparatus comprising:

control means for causing the rear edge of the first original to come in contact with one side of the registration means and causing the leading edge of the second original to come in contact with the other side of the registration means and then, the second driving means is operated, and thereafter, the first driving means is further operated.

8. The apparatus of claim 7, wherein the control means includes means for outputting a signal for starting the drive of the second driving means after it has outputted the signal for starting the drive of the first driving means.

* * * * *